US007490641B2

(12) United States Patent
McGehee et al.

(10) Patent No.: US 7,490,641 B2
(45) Date of Patent: Feb. 17, 2009

(54) OPTIMIZING PLANER SYSTEM AND METHOD

(75) Inventors: Ronald W. McGehee, Ukiah, CA (US); Patrick Doyle, Ukiah, CA (US)

(73) Assignee: USNR/Lockums Cancar Company, Vancouver, WA (US)

( * ) Notice: Subject to any disclaimer, the term of this patent is extended or adjusted under 35 U.S.C. 154(b) by 344 days.

(21) Appl. No.: 10/799,600

(22) Filed: Mar. 15, 2004

(65) Prior Publication Data

US 2004/0177896 A1 Sep. 16, 2004

Related U.S. Application Data

(60) Provisional application No. 60/463,174, filed on Apr. 15, 2003, provisional application No. 60/454,248, filed on Mar. 13, 2003.

(51) Int. Cl.
*B27C 1/00* (2006.01)

(52) U.S. Cl. ..... 144/117.1; 144/130; 144/248.5; 144/357; 144/375

(58) Field of Classification Search ..... 144/39, 144/117.4, 118, 129, 130, 242.1, 243, 246.1, 144/248.2, 248.5, 250.23, 117.1, 357, 373, 144/369, 375, 3.1, 116, 356
See application file for complete search history.

(56) References Cited

U.S. PATENT DOCUMENTS 3,379,230 A 4/1968 Roehrig
3,535,140 A 10/1970 Busch
3,746,065 A 7/1973 Mason
4,239,072 A 12/1980 Merilainen
4,356,670 A 11/1982 Freerks
4,438,795 A 3/1984 Plough
4,449,557 A 5/1984 Makela et al.
4,457,350 A * 7/1984 Finnila ..... 144/400
4,524,858 A 6/1985 Maxey
4,561,477 A 12/1985 Zimmerman
4,774,988 A 10/1988 Washburn et al.
4,823,851 A * 4/1989 Seffens ..... 144/245.1
4,831,545 A 5/1989 Floyd et al.
4,844,134 A 7/1989 Martindale
4,879,659 A * 11/1989 Bowlin et al. ..... 700/167
5,251,681 A 10/1993 Davenport
5,284,192 A 2/1994 Sato et al.
5,368,077 A 11/1994 Croghan et al.

(Continued)

*Primary Examiner*—Bena Miller
(74) *Attorney, Agent, or Firm*—Schwabe, Williamson & Wyatt, P.C.

(57) ABSTRACT

An optimizing planer system includes a control system; a workpiece feed path; and, an optimizing planer. The optimizing planer is operably coupled to the control system. The optimizing planer is located along the workpiece feed path and has an entrance, for receipt of a rough workpiece, and an exit, for discharge of an at least partially finished workpiece. The optimizing planer includes a cutting element. A workpiece interrogator is situated along the workpiece feed path, upstream of the entrance. The interrogator is operably coupled to the control system so to provide the control system with workpiece property information for each workpiece entering the optimizing planer. The control system provides the optimizing planer with control information based upon the workpiece property information for each workpiece. The optimizing planer is constructed to move at least one of the workpiece and the cutting element as the workpiece passes through the optimizing planer according to the control information for each workpiece.

22 Claims, 32 Drawing Sheets

U.S. PATENT DOCUMENTS 5,373,879 A 12/1994 Kuhnhenrich
5,396,938 A * 3/1995 Cannaday ..... 144/357
5,419,425 A 5/1995 Goater
5,761,979 A 6/1998 McGehee
5,765,617 A * 6/1998 Mierau et al. ..... 144/387
5,816,302 A 10/1998 Newnes
5,853,038 A 12/1998 Newnes
5,884,682 A * 3/1999 Kennedy et al. ..... 144/357
5,946,995 A 9/1999 Michell et al.
6,016,593 A 1/2000 Kyrstein
6,247,511 B1 6/2001 Maeda et al.
6,272,437 B1 8/2001 Woods et al.
6,470,932 B1 * 10/2002 Grivna et al. ..... 144/373
6,473,186 B2 10/2002 Kawasaki et al.
2001/0054414 A1 12/2001 Allison et al.
2002/0015252 A1 2/2002 Noble et al.

* cited by examiner

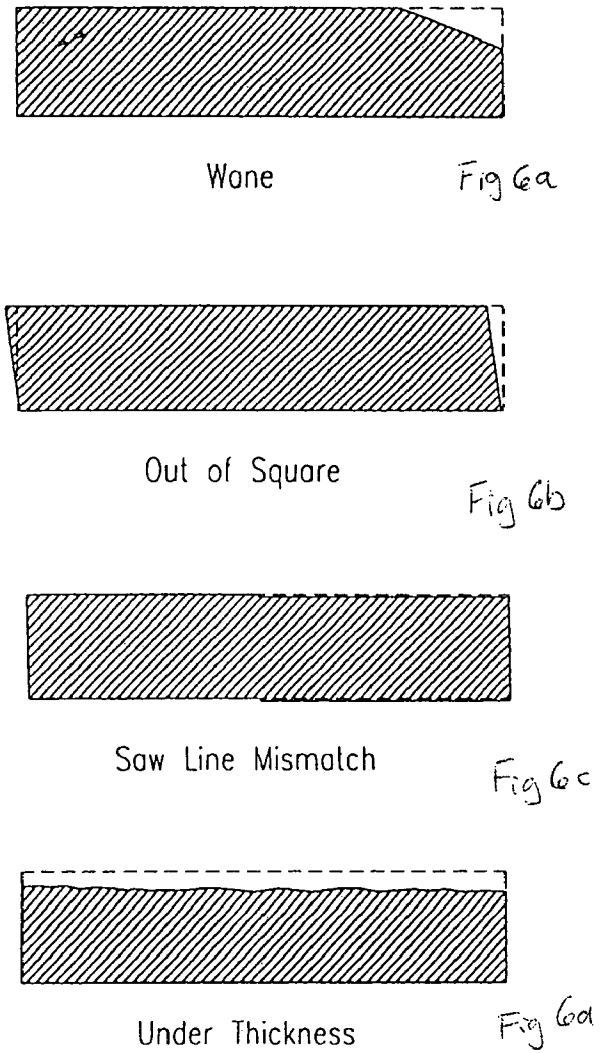
Wone
Fig 6a
Out of Square
Fig 6b
Saw Line Mismatch
Fig 6c
Under Thickness
Fig 6d
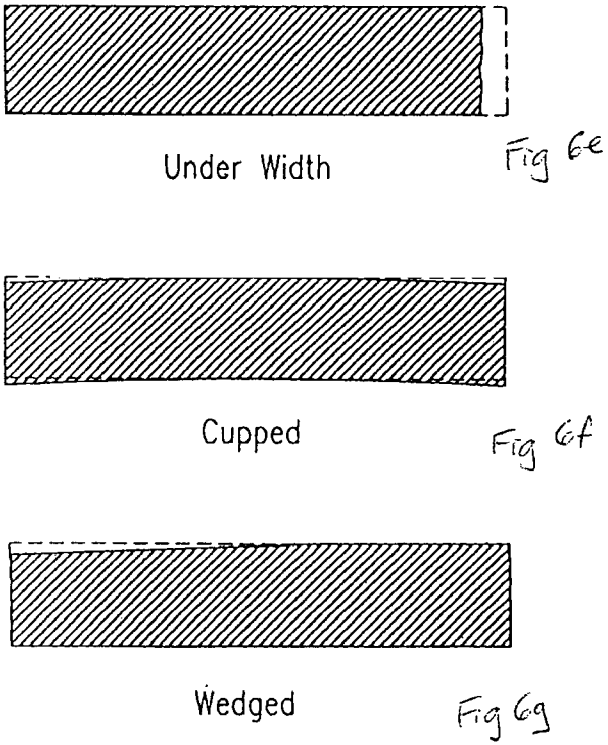
Under Width
Fig 6e
Cupped
Fig 6f
Wedged
Fig 6g 25
5
Cross-section at back end of work piece

6

25
5
Cross-section at front end of work piece 30
5

Side view of rough work piece

OPTIMIZING PLANER SYSTEM AND METHOD

CROSS REFERENCE TO RELATED APPLICATION

This application claims priority from U.S. Provisional Patent Application No. 60/454,248 filed Mar. 13, 2003 entitled Optimizing Planer System and Method and U.S. Provisional Patent Application No. 60/463,174 filed Apr. 15, 2003 entitled Optimizing Planer System and Method.

FIELD OF THE INVENTION

This invention relates to improvements in planing workpieces in a planermill and in particular to an optimizing planer system and method.

BACKGROUND OF THE INVENTION

A planer, planer-matcher, or moulder are similar machines widely used throughout the wood processing industry to turn rough workpieces into finished workpieces such as surfaced lumber and contoured shapes like molding, flooring and siding. The planer's primary function is to produce a desired cross-sectional profile with an adequate surface finish out of the rough workpiece being processed. The planer is one part of a group of equipment known as the planer mill.

Typically the planer processes material at speeds from 100 to 2000 feet per minute. The planer will typically remove between 0.050" to 0.150" from the overall height and width of most workpieces but more or less may be required depending on the application. Typical planers are used to process workpieces with cross-sectional dimensions from under 1"×1" to 8"×25".

FIG. 1 shows a diagram of the typical flow of material through a conventional prior art planer. The rough workpiece is typically fed on a table conveyor through a 90 degree transfer onto the planer infeed conveyor. The workpieces then typically feed single-file end-to-end through the planer. After the finished workpiece leaves the planer it typically turns 90 degrees onto an outfeed table conveyor where it continues on for further sorting and processing.

In modern planner mill installations a grading scanner is sometimes used after the planer to create a three-dimensional profile of each finished workpiece. This profile data contains cross-sectional information measured periodically along the length of each workpiece. The profile data of each workpiece is then used by the Graderman to determine the proper grade and optimal length of each workpiece.

FIGS. 2*a* and 2*b* show simplified side and top views of a typical prior art planer. The key elements of the planer as shown, are as follows:

a) Top and bottom feed rolls
b) Inside guide
c) Top and bottom planer heads
d) Top chip breaker
e) Pressure bar
f) Bed plate
g) Tail plate
h) Inside and outside planer heads
i) Side chip breaker
j) Top and bottom outfeed rolls The exact configuration and name given to each machine component may change based on manufacturer, model, and the material being processed.

When a typically configured planer is setup for a given production run the operator aligns the bed plate and the inside guide relative to the cutter heads to remove a fixed amount from the bottom and one side of each workpiece. The top cut and the remaining side cut are then made removing the balance of wood required to obtain the desired shape.

Applicant is aware of the following U.S. Pat. Nos. 5,761,979; 4,239,072; 4,449,557, 5,816,302; 5,853,038; 5,946,995; and 5,884,682.

SUMMARY OF THE INVENTION

Method of Controlling a Planer:

One aspect of the invention involves the recognition that current planers do not extract the highest value finished workpiece possible from each incoming rough workpiece. Since current planers repeatedly position the desired cross-sectional profile in the same location relative to the incoming workpieces' fixed sides—typically the bottom and one side—the planer will at times remove excess material from a side containing a better more complete edge while removing a small amount of material from a side containing a poorer quality edge. This invention seeks to capitalize on positioning the desired cross-sectional profile optimally based on the geometric shape profile of the incoming rough workpiece.

This invention presents a new method of optimized planer operation and control. A geometric scanning system, located upstream from the planer, measures the dimensional profile of each individual rough workpiece. The profile data of each individual workpiece is then used during the planning operation to:

a) Control the planer to produce an optimized finished workpiece out of each rough workpiece, and optionally
b) Control the planer or other equipment to trim down or split to a smaller nominal size a particular rough workpiece that would have otherwise produced a lower value or unusable finished workpiece (e.g., having the option of producing one 2×6 or two 2×4's while cutting 2×8's).

In summary, the optimizing planer system according to one aspect of the present invention includes a control system; a workpiece feed path; and, an optimizing planer. The optimizing planer is operably coupled to the control system. The optimizing planer is located along the workpiece feed path and has an entrance, for receipt of a rough workpiece, and an exit, for discharge of an at least partially finished workpiece. The optimizing planer includes a cutting element. A workpiece interrogator is situated along the workpiece feed path, upstream of the entrance. The interrogator is operably coupled to the control system so to provide the control system with workpiece property information for each workpiece entering the optimizing planer. The control system provides the optimizing planer with control information based upon the workpiece property information for each workpiece. The optimizing planer is constructed to move at least one of the workpiece and the cutting element as the workpiece passes through the optimizing planer according to the control information for each workpiece.

The optimizing planer system may be characterized in a further aspect as including means for interrogating each workpiece entering the optimizing planer and creating workpiece property information therefor; control system means operably coupled to the workpiece interrogating means, for providing the optimizing planer with control information based upon the workpiece property information for each workpiece. The optimizing planer may include means for moving at least one of the workpiece and the cutting element as the workpiece passes through the optimizing planer according to the control information for each workpiece.

The present invention may also include a method for planer optimization. The method may include the steps of feeding a series of workpieces to an optimizing planer; interrogating each workpiece prior to entering the optimizing planer to formulate workpiece property information for each workpiece; creating control information for each workpiece from the workpiece property information; and, controlling the cutting operation of the optimizing planer for each workpiece based upon the control information for each workpiece.

Benefits to an optimizing planer may include:

a) Higher quality workpieces with more complete shape profiles resulting in higher grade production
b) Production of a more uniform chip leading to a more uniform and higher quality surface finish
c) Generally more uniform power consumption top-to-bottom and side-to-side resulting in better more even feeding.

BRIEF DESCRIPTION OF THE DRAWINGS

In the drawings forming part of this specification, wherein similar characters of reference denote corresponding parts in each view.

FIGS. 6*a*-6*g* are lateral cross sections of a workpiece illustrating typical cross sectional defects as found on rough workpieces feeding a planer.

FIG. 17*b* is, in plan view, the optimizing planer of FIG. 17*a*.

DETAILED DESCRIPTION OF EMBODIMENTS OF THE INVENTION

Figure 1:
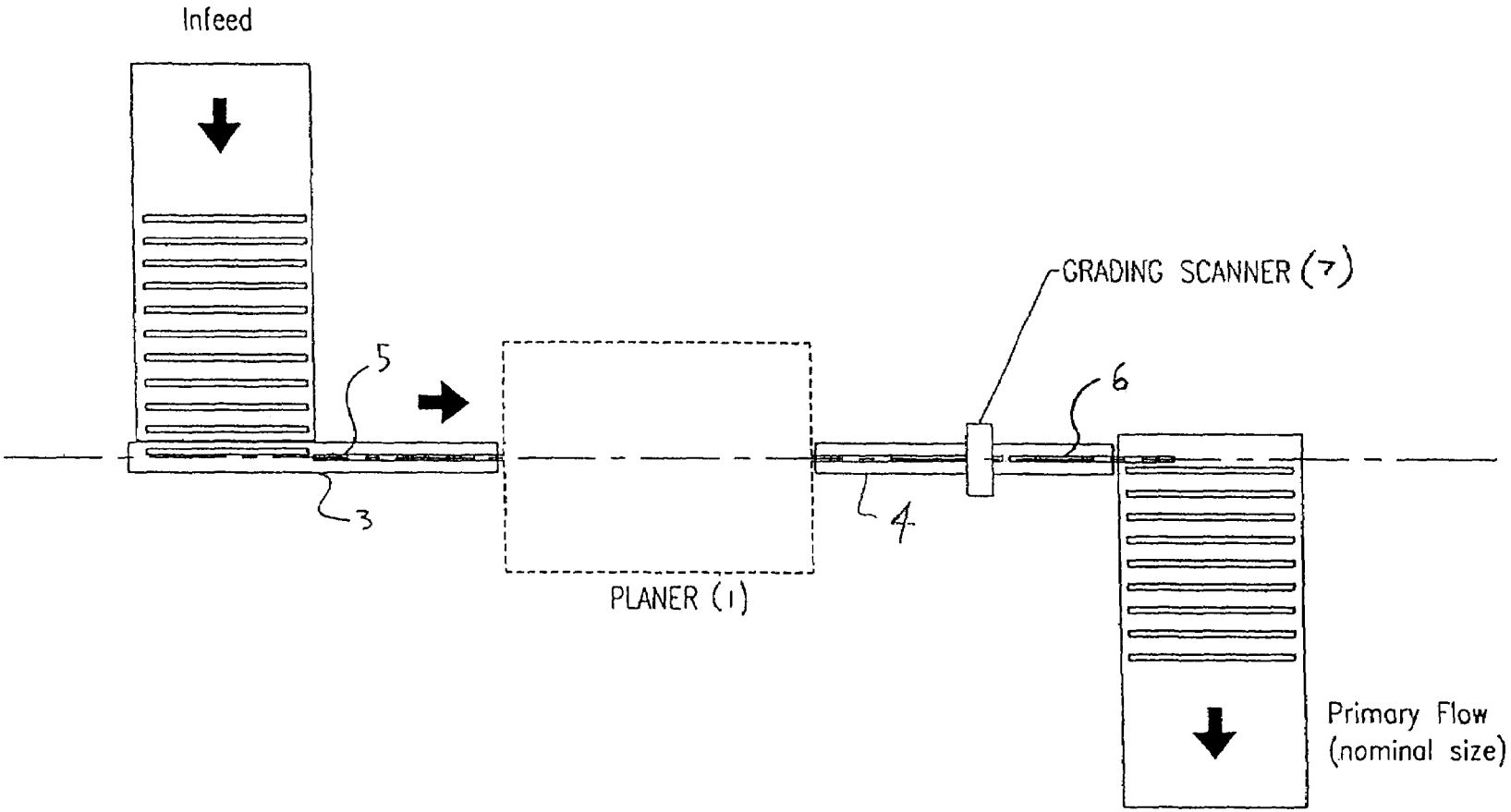
FIG. 1 is, in diagrammatic plan view, a prior art planer control configuration.
Figures 2A, 2B:
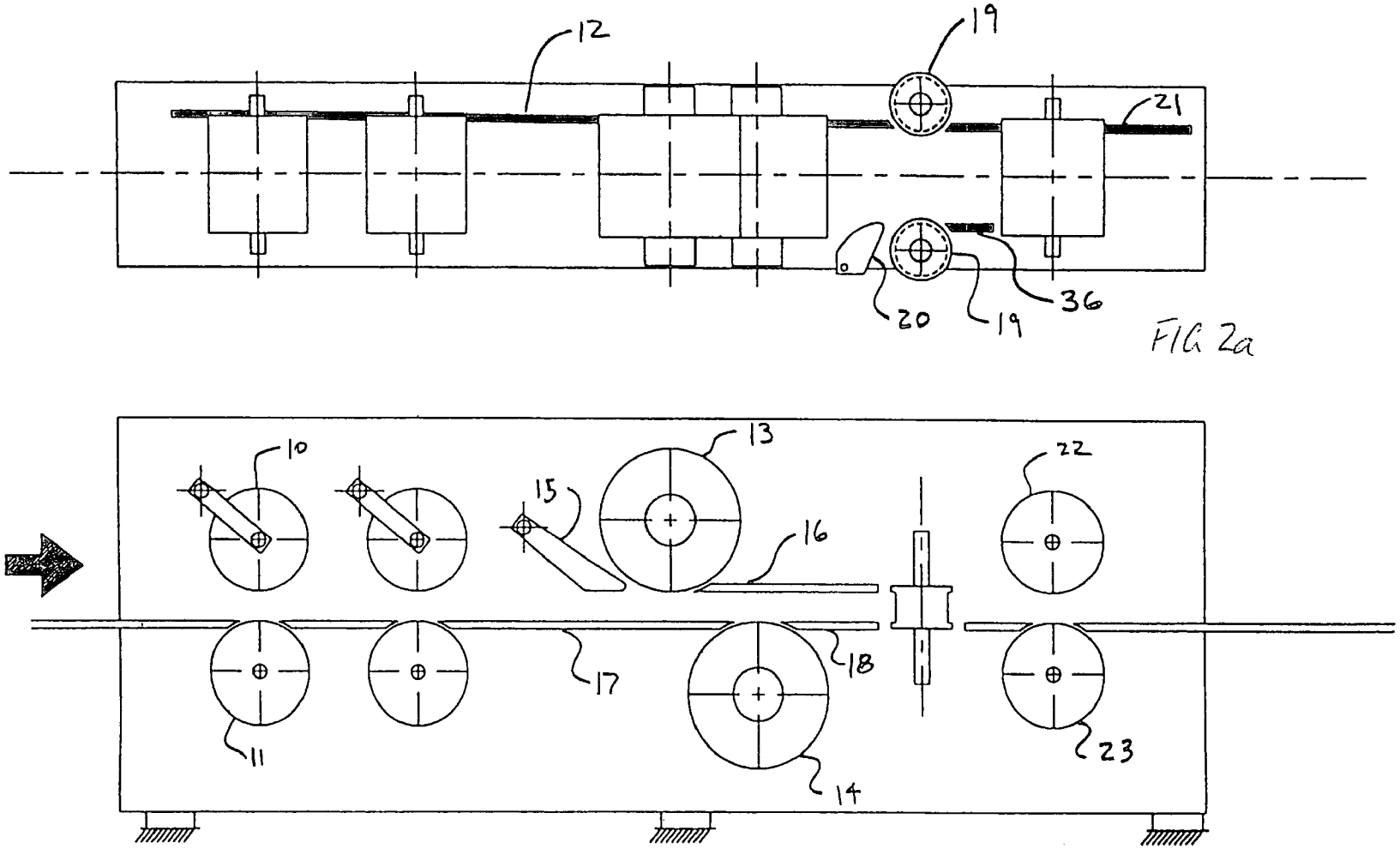
FIG. 2*a* is, in plan view, a prior art planer apparatus.
FIG. 2*b* is, in side elevation view, the prior art planer apparatus of FIG. 2*a*.
Figure 3:
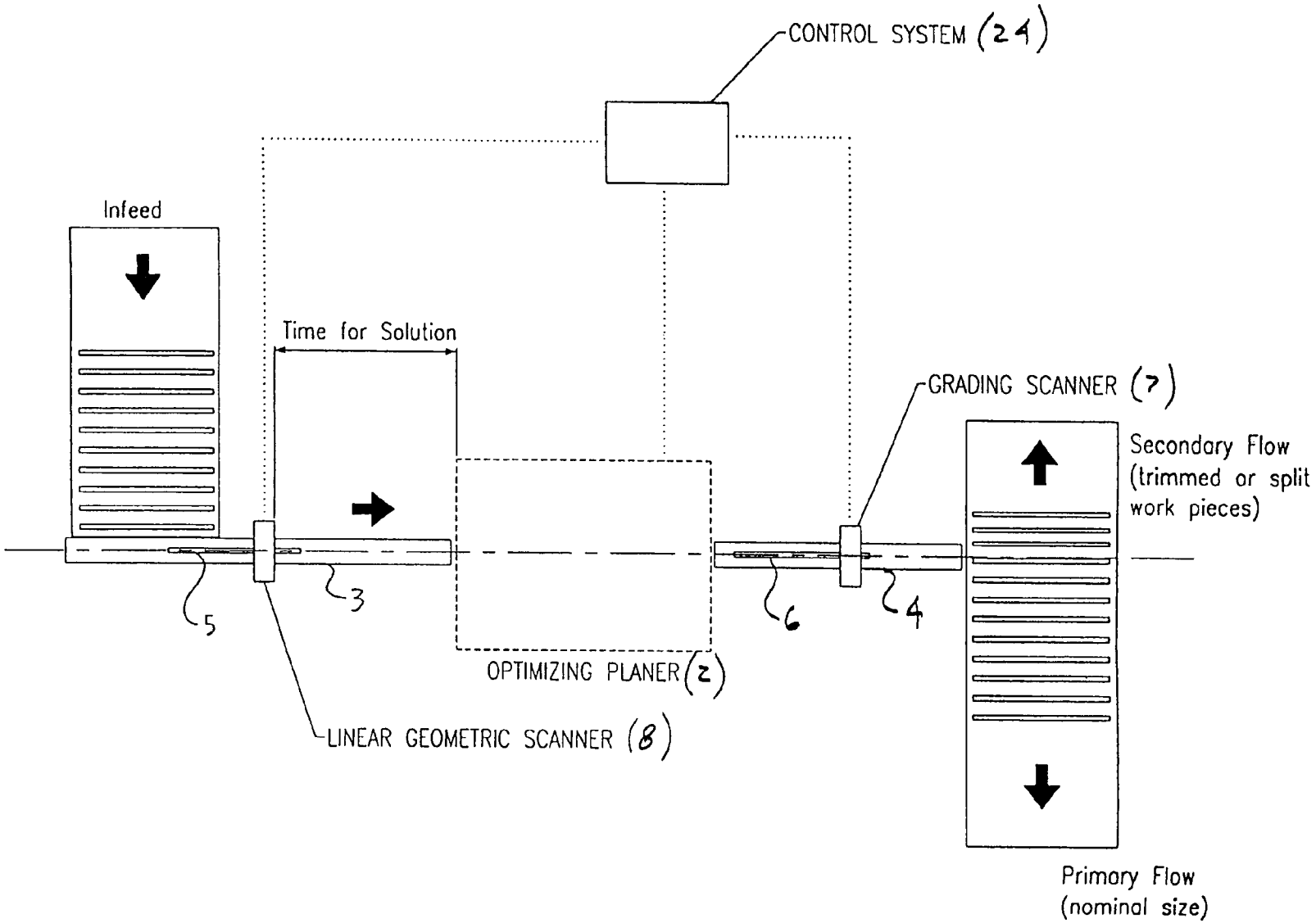
FIG. 3 is, in diagrammatic plan view, an optimizing planer configuration according to one embodiment of the present invention incorporating a single linear scanner.
Figure 4:
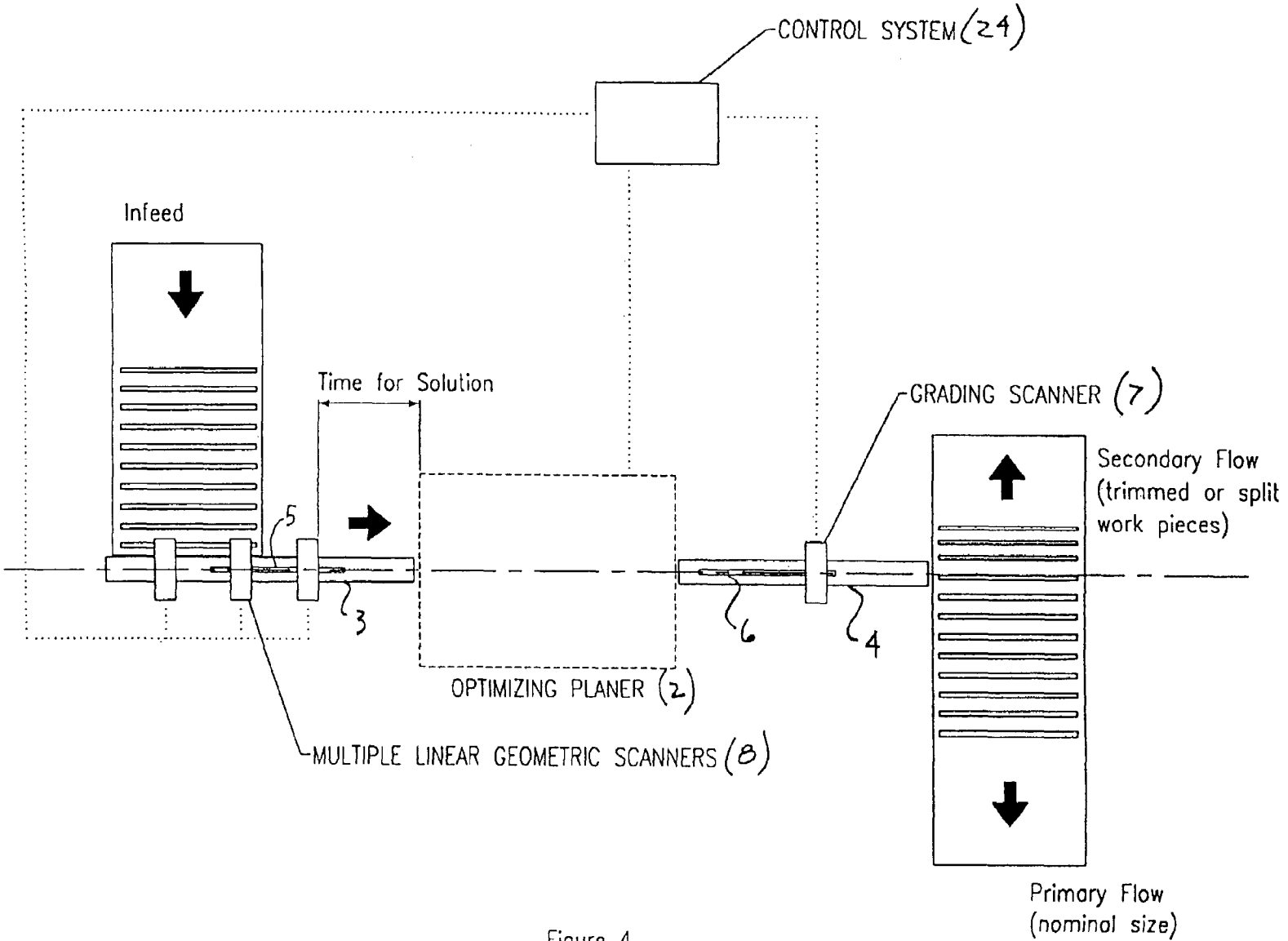
FIG. 4 is, in diagrammatic plan view, the optimizing planer according to a further embodiment of the present invention incorporating multiple linear scanners.
Figure 5:
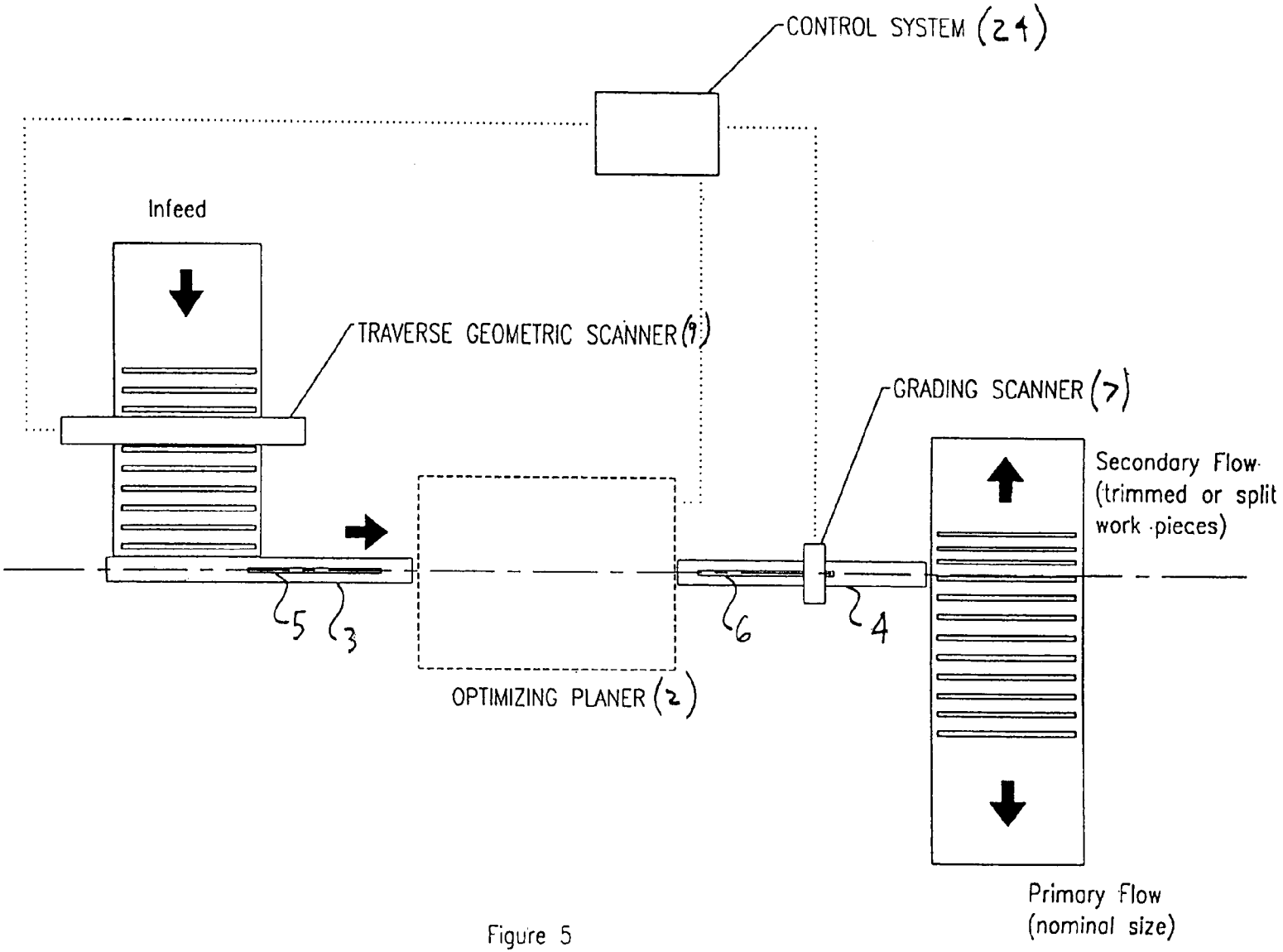
FIG. 5 is, in diagrammatic plan view, a further embodiment of the optimizing planer according to the present invention incorporating a transverse scanner.
Figure 7:
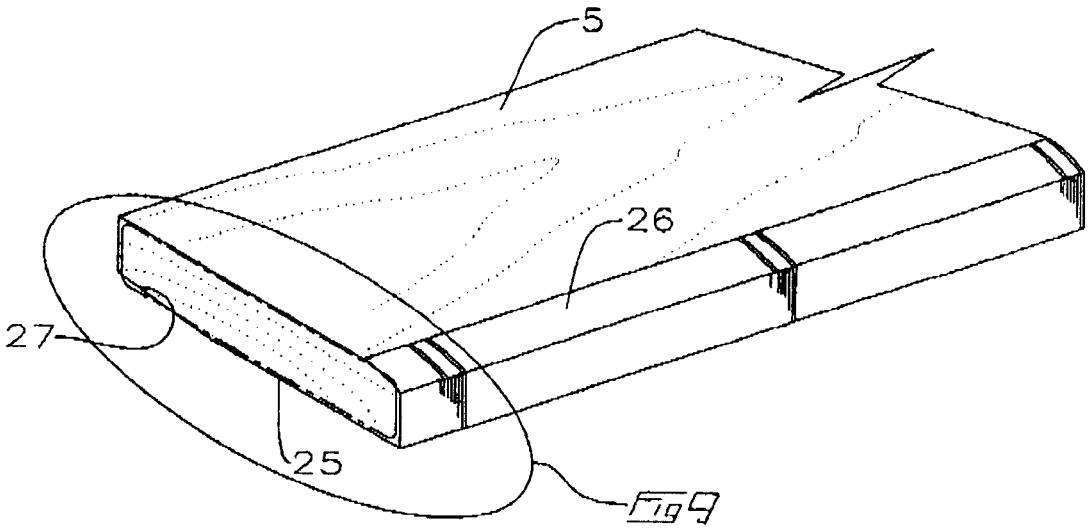
FIG. 7 is, in perspective view, a rough workpiece prior to non-optimizing planing.
Figure 8:
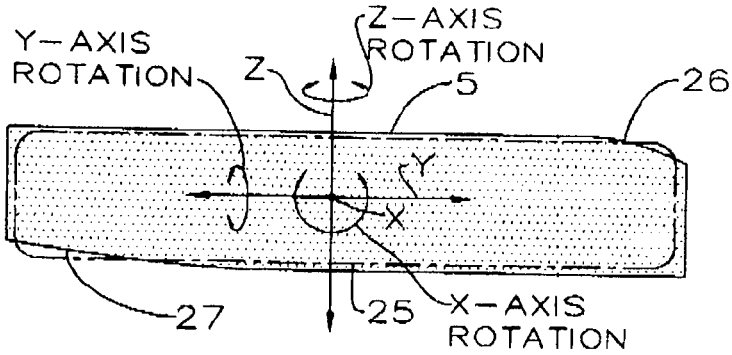
FIG. 8 is, in elevation view, the workpiece of FIG. 7 and illustrating the defects, non-optimized target profile and principal axes of the workpiece.
Figure 9:
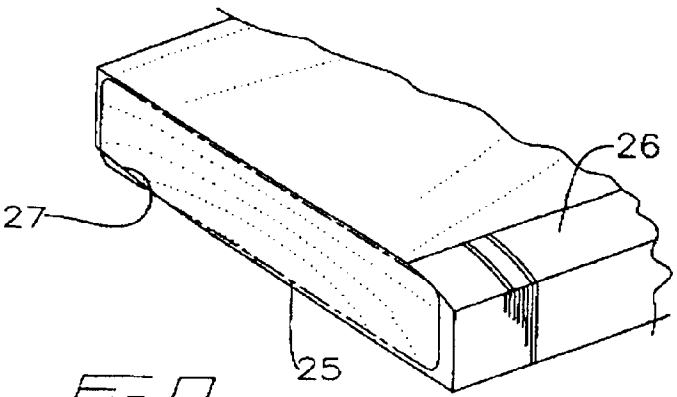
FIG. 9 is an enlarged portion of the workpiece of FIG. 7.

FIGS. 3, 4 and 5 show various configurations for controlling an optimizing planer.

FIG. 3 shows a simplified diagram of one preferred embodiment of the invention where a single linear geometric scanner is located just before the optimizing planer. The scanner interrogates each workpiece, typically by conventional lasers scanning techniques, to formulate workpiece property information in the form of geometric profile information for each workpiece. The geometric profile information is provided to a control system. The control system uses the geometric profile information from the linear scanner to create control information for the optimizing planer. This permits the optimizing planer to make any necessary changes to how the optimizing planer handles a particular rough workpiece. Note that in some cases there will be no need to change how the optimizing planer handles a workpiece. Note that a certain distance is required between the scanner and the planer to provide enough time to completely scan and determine an optimized cutting solution for each workpiece.

FIG. 4 shows an alternative embodiment where each workpiece is scanned by more than one linear scanner. The geometric profile data from each scanner is compiled into one profile for each individual workpiece. This approach reduces the distance required between the last scanner and the planer. For example, if a 20 ft long workpiece passes under 4 scanners, only five feet of travel is required to scan the entire piece.

FIG. 5 shows an alternative embodiment where each workpiece is scanned by a transverse scanner or multiple transverse scanners. The geometric profile data for each workpiece is acquired as the material flows sideways past the scanner or scanners.

In each of these scanner configurations a grading scanner located after the planer may or may not be used. Preferably a grading scanner is used. The grading scanner may be used to feedback information to the control system on how close the planer is cutting to the intended size and geometry; the control system may use the grading scanner geometric profile data to update the target cutter locations. This closed-loop control scheme offers tremendous opportunities to improve long-term cutting accuracy.

FIGS. 6*a-g* show examples of typical cross-sectional geometric profile defects found in workpieces being fed into a planer. In reality workpieces fed to a planer will typically have a combination of these defects.

Figure 10:
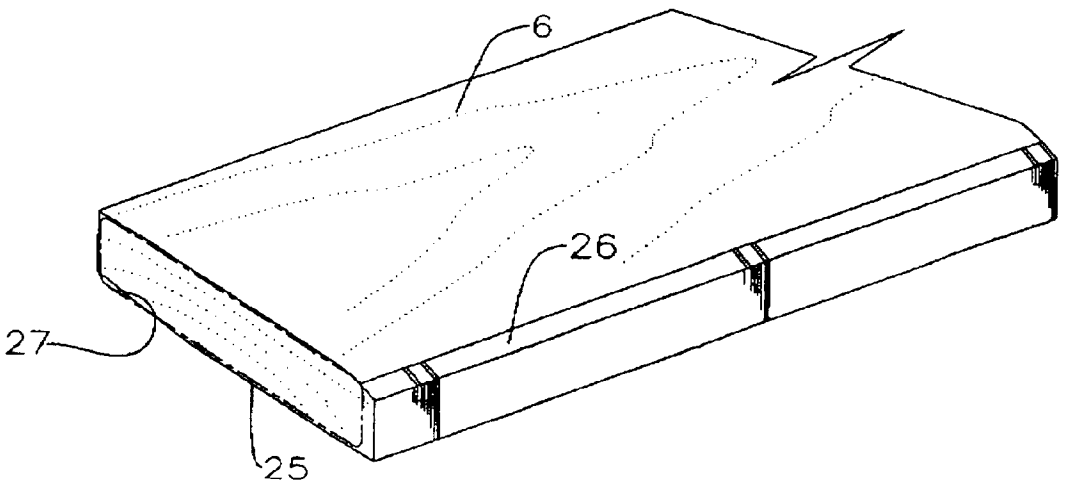
FIG. 10 is, in perspective view, the finished workpiece following the non-optimized planing of the workpiece of FIG. 7.

FIGS. 7 through 13 show an example of a single rough workpiece with two typical shape defects found on material entering a planer. This example rough workpiece 5 has both wane 26 and a wedge 27 defect running its length. The desired cross-sectional profile 25 is shown. FIGS. 7 through 10 depict the planning operation with a non-optimizing planer where the desired cross-sectional profile is located in a fixed position within the workpiece. FIG. 10 shows the finished workpiece retaining portions of the wane and wedge defects.

Figure 11:
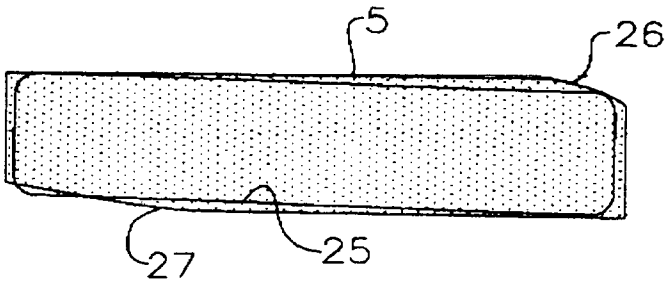
FIG. 11 is, in elevation view, a rough workpiece prior to optimized planing.
Figure 12:
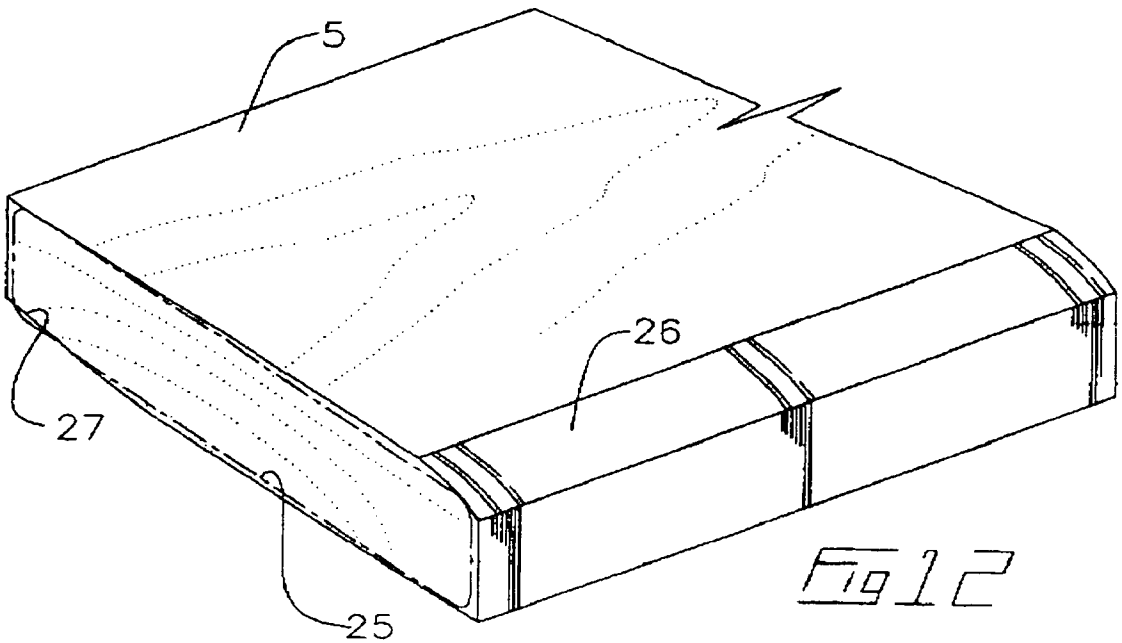
FIG. 12 is, in perspective view, the rough workpiece of FIG. 11.
Figure 13:
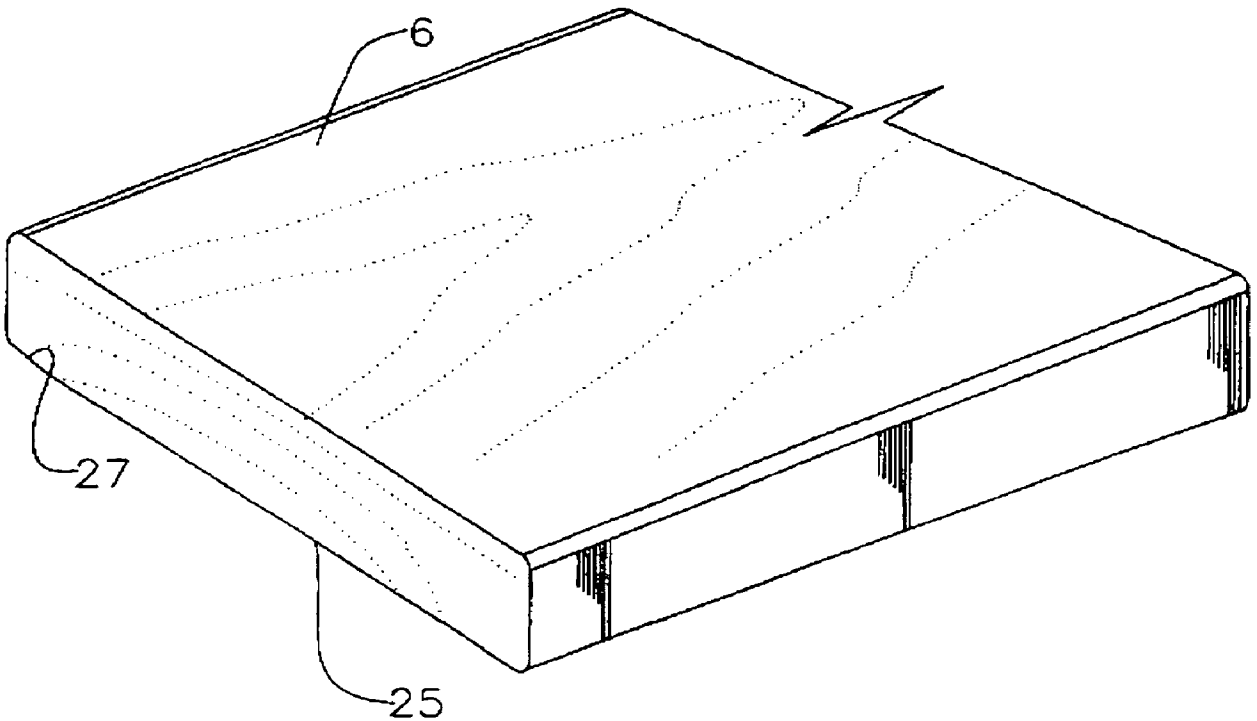
FIG. 13 is, in perspective view, the finished workpiece following optimized planing of the rough workpiece of FIG. 12.
Figures 14A, 14B, 14C, 14D:
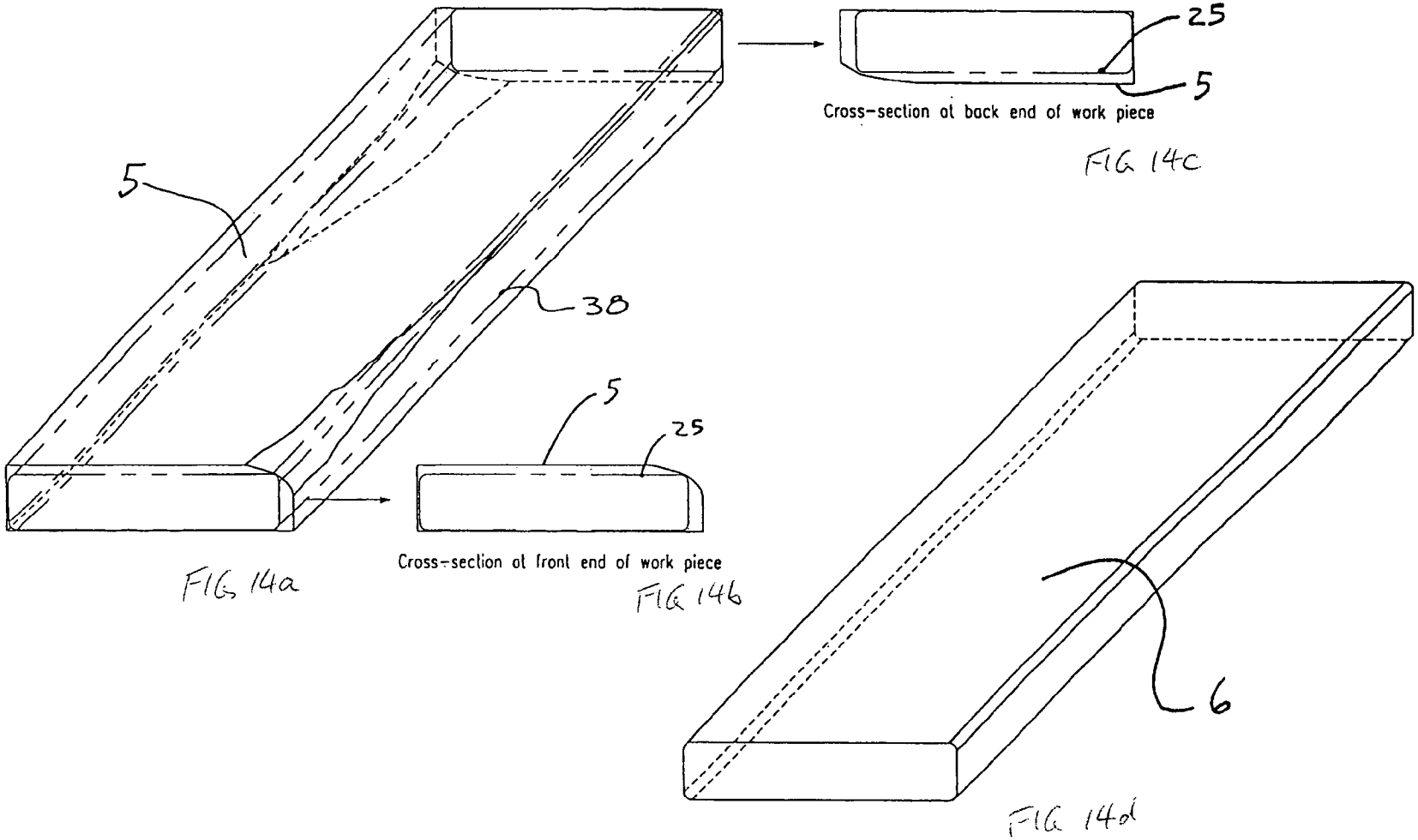
FIG. 14*a* is, in perspective view, a rough workpiece having diametrically opposed wane defects on opposite front and back ends of the workpiece.
FIG. 14*b* is, in front end elevation view, the rough workpiece of FIG. 14*a*.
FIG. 14*c* is, in back end elevation view, the rough workpiece of FIG. 14*a*.
FIG. 14*d* is, in perspective view, the finished workpiece resulting from optimized planing of the rough workpiece of FIG. 14*a*.

FIGS. 11 through 13 depict the planing of the same rough workpiece using an optimizing planer where the piece's cross-sectional profile is known. In this example the best quality finished workpiece is most optimally obtained by slightly rotating the desired cross-sectional profile within the piece being planed. This operation best utilizes the available wood present in the workpiece while avoiding its shape defects. The resulting finished workpiece, shown in FIG. 13, has no wane defect and only a small wedge defect.

To produce the most optimized finished workpiece the planer will preferably need to adjust the location of the desired cross-sectional profile both workpiece-to-workpiece and within a single workpiece. To achieve optimized planing, the location of the desired cross-sectional profile, moving through the X axis, may move in any of the following ways relative to the workpiece being planed (refer to FIG. 8 for orientation of coordinates):

a) up-and-down linear movements (Z axis)
b) side-to-side linear movements (Y axis)
c) twisting movements, or rotating about the center of the workpiece (X axis rotation)

Again these movements may happen once (if needed) for each individual workpiece or more that once throughout the planing operation within a given workpiece.

FIGS. 14*a-d* show a rough workpiece with wane defects located mostly on opposite edges at opposite ends of the piece. The outline of the intended finished workpiece shows how it is best positioned within the rough workpiece to most optimally plane a finished piece. Note that both side-to-side (Y axis) and up-and-down (Z axis) movements are required through the piece (moving in the X axis).

As the control system repositions the location of the desired cross-sectional profile within the workpiece it will have constraints to balance the amount of self-produced defects (such as twist, bow, snipe, etc.) with improvements made to surface and edge quality so that the finished workpiece stays most optimally within standard grading tolerances while obtaining the highest value possible. Feedback from the grading scanner may be especially helpful in this regard.

The control system may optionally make gross profile changes to trim or split a given workpiece that is determined to be a good candidate for such modified treatment. This usually occurs when the modified treatment will create a higher value finished product from a particular rough workpiece. The control system will initiate the introduction of cutting equipment to make this desired cut on individual or multiple workpieces. For example, the control system can direct cutting components of the planer to either (1) cut off a portion of the workpiece before the side heads thus permitting the side heads to plane the piece into a smaller nominal size or (2) split the workpiece into two usable pieces with a cutter located after the side heads.

In addition to traditional geometric scanning equipment that uses lasers to measure the profile other workpiece interrogators may be used to detect the incoming workpiece's properties to control the planer. Examples of such workpiece interrogators may include, vision systems, ultrasonic based geometric scanners, moisture meters, and contacting thickness gauges. These alternative instruments may be used as the exclusive defect detection device, in conjunction with each other, or in conjunction with traditional laser based geometric scanners. These alternative instruments may detect workpiece geometry, detect information, or other relevant data that could be used to most optimally plane each individual workpiece. Examples of measured properties besides geometric data includes grain geometry, knot geometry, surface finish, moisture, and color variation. For example, the existence of a knot near or along an edge may not be detected by a geometric scanner but may be detected by a color variation monitor; this information may be used to modify the optimal cutting scheme so that, for example, the knot is not an edge or the equipment can be instructed to make a 2×6 instead of a 2×8.

Apparatus:

FIGS. 15*a* through 21 show various planer configurations that all utilize upstream defect data to optionally position the desired cross-sectional profile while planing each individual rough workpiece. Planers can be of three general classifications, designs with movable workpiece positioning module(s), designs with movable planing heads, and systems that use a combination of movable infeed and outfeed sections and movable planing heads.

The terms "movable" or "guiding" describes components that are repositioned in response to geometric profile or defect data of each individual incoming workpiece. "Fixed" or "stationary" components may be adjustable but would typically move only while the machine is not in operation and would not be controlled by upstream profile or defect data.

An optimizing planer may be constructed of traditional design where the top and bottom heads are positioned horizontally or an alternative design where the main planer heads are positioned other than horizontal including vertical. Planers designed with the main planer heads not aligned horizontally may seek to provide better infeed workpiece positioning compared to traditionally designed planers. Gravity could assist in keeping a workpiece aligned against the infeed guides. For simplicity all designs are shown constructed with the main planer heads oriented horizontally.

Figures 15A, 15B:
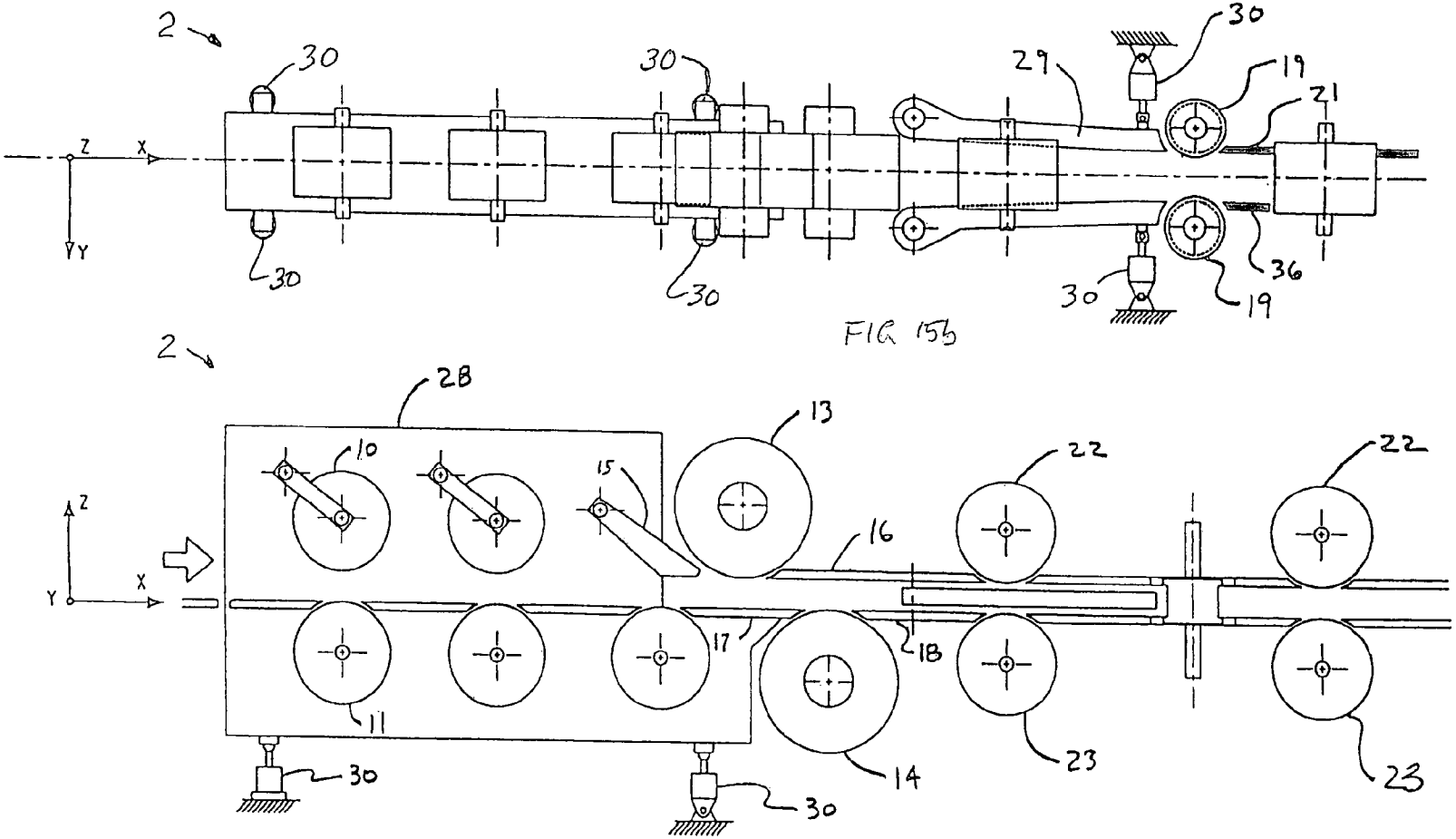
FIG. 15*a* is, in side elevation view, a further embodiment of the optimizing planer according to the present invention having a three axis infeed positioning module with intermediate side head steering.
FIG. 15*b* is, in plan view, the optimizing planer of FIG. 15*a*.

FIGS. 15*a-b* show a preferred embodiment of an optimizing planer where the cutting elements are held stationary. Workpiece optimization is obtained by guiding each individual workpiece through two separate stationary planer head stations.

First the workpiece is guided through the top and bottom heads by a multiple axis infeed positioning module. This infeed module has three axes of control to properly guide the workpiece through the stationary heads. This includes:

a) up-and-down (Z axis linear movement via simultaneous actuation of all four linear positioners), b) pitch (Y axis rotation via movement of the two linear positioners on the module's entrance differently from movement of the two linear positioners on the module's exit.), and c) twist (X axis rotation via movement of the linear positioners on one side differently from any movement of the linear positioners on the other side).

The second cutting station, the intermediate feed module with side steering anvils and the inside and outside planer heads, requires only Y axis movement to guide the workpiece through the stationary planer heads.

The optimizing planer shown in FIGS. 15*a-b* may alternatively have an infeed positioning module with fewer axes of control. The infeed module may have any one or a combination of Z-axis linear movement, X axis rotation, and/or Y-axis rotation.

Figure 16B:
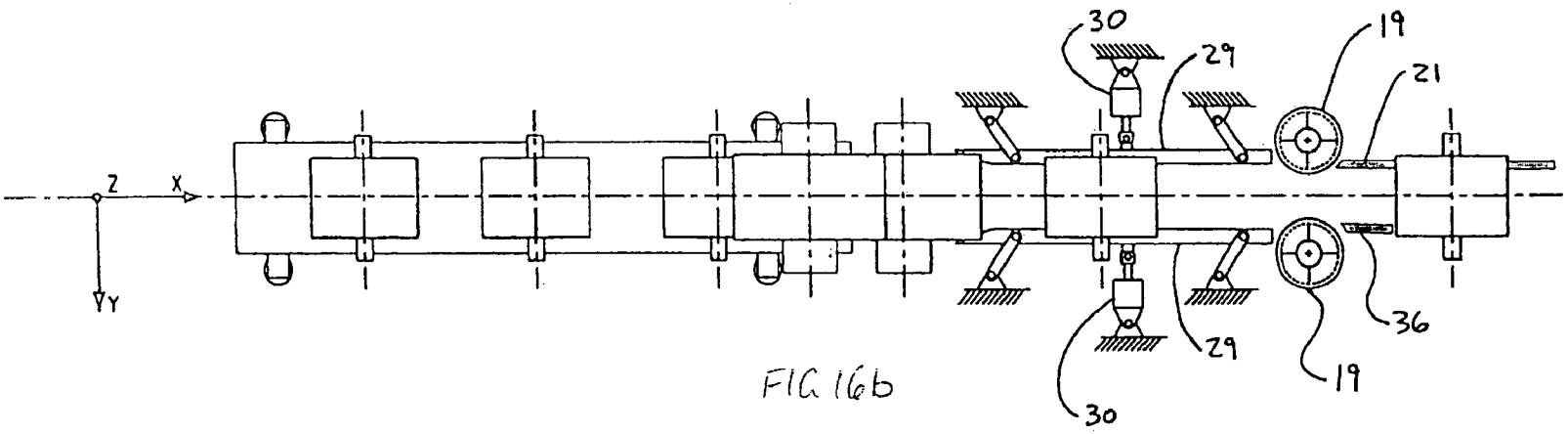
FIG. 16*b* is, in plan view, the optimizing planer of FIG. 16*a*.
Figure 16A:
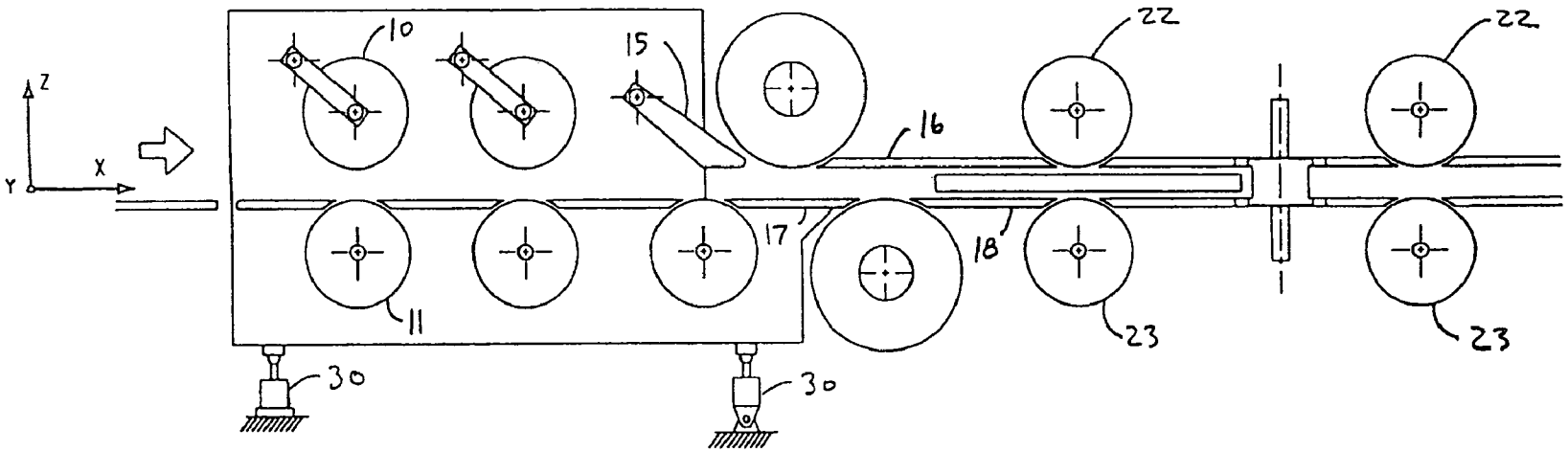
FIG. 16*a* is, in side elevation view, a further embodiment of the optimizing planer according to the present invention having a three axis infeed positioning module with parallel intermediate side head steering.

FIGS. 16*a-b* show a variation similar to that shown in FIGS. 15*a-b*. This design uses a multiple axis infeed positioning module where the intermediate feed module uses steering anvils that run nearly parallel to the workpiece to provide a better guiding edge as opposed to the pivoting steering anvils of FIGS. 15*a-b*.

Figure 17A:
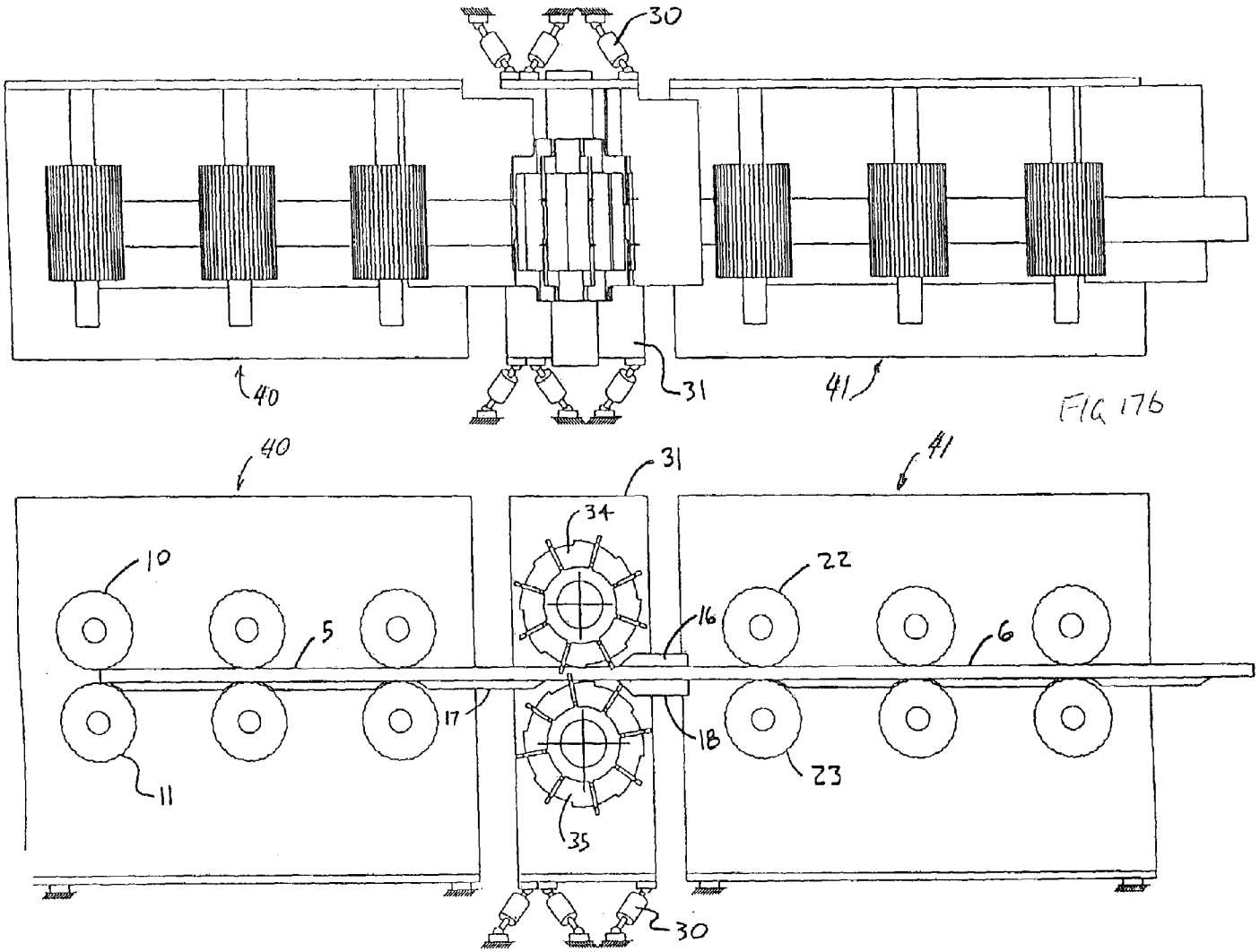
FIG. 17*a* is, in side elevation view, a further embodiment of the optimizing planer according to the present invention having a single plane six axis shaping module.
Figure 19:
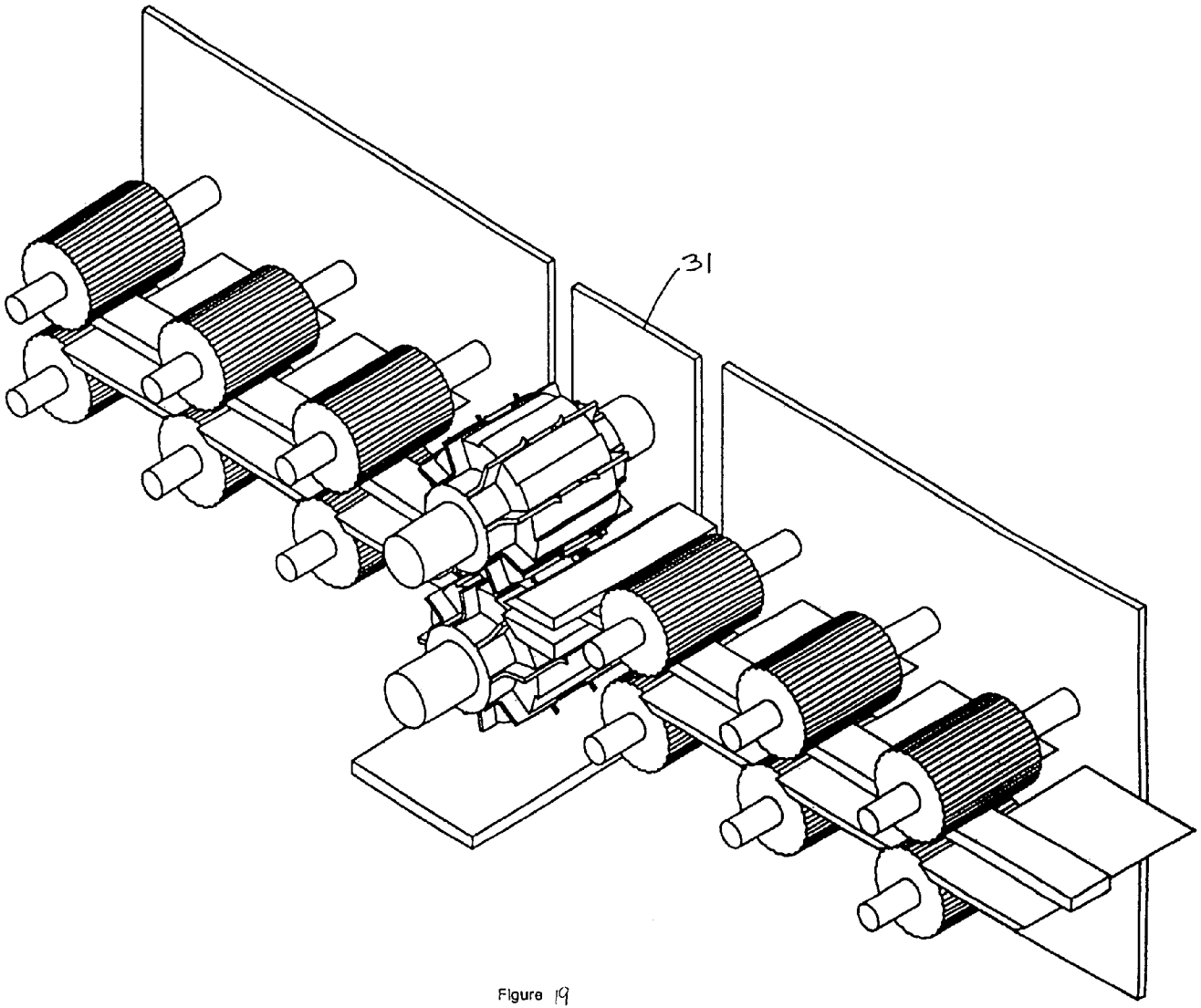
FIG. 19 is, in perspective view, the embodiment of the optimizing planer according to the present invention having a single plane shaping module.

FIGS. 17*a-b* and 19 show an alternative embodiment of an optimizing planer where the infeed and outfeed guide and feed roll modules are held stationary during operation. Workpiece optimization is obtained in this case by moving the cutting elements, pressure bar and tail plate as the workpiece moves through the planer. Up to six axes of control can be used to most optimally produce the desired finished workpiece. This includes control of:

a) forward and backwards (X axis movement), b) side-to-side (Y axis linear movement), c) up-and-down (Z axis linear movement), d) twist (X axis rotation), e) pitch (Y axis rotation), and f) skew (Z axis rotation).

This embodiment uses top and bottom planer heads with integrated side cutters. These combination heads require a linkage system to provide for their timed movements so that the side cutting elements do not interfere with each other. This design profiles a workpiece in approximately a single plane. This design has the benefits of a more compact design with simpler controls.

Figure 18B:
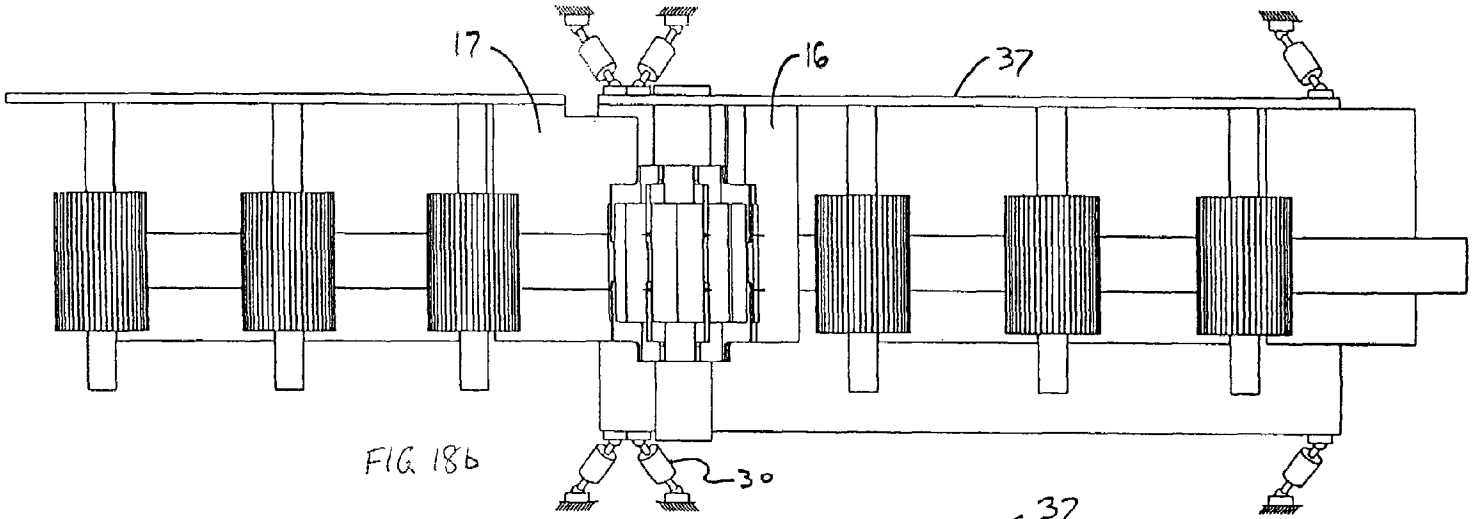
FIG. 18*b* is, in plan view, the optimizing planer of FIG. 18*a*.
Figure 18A:
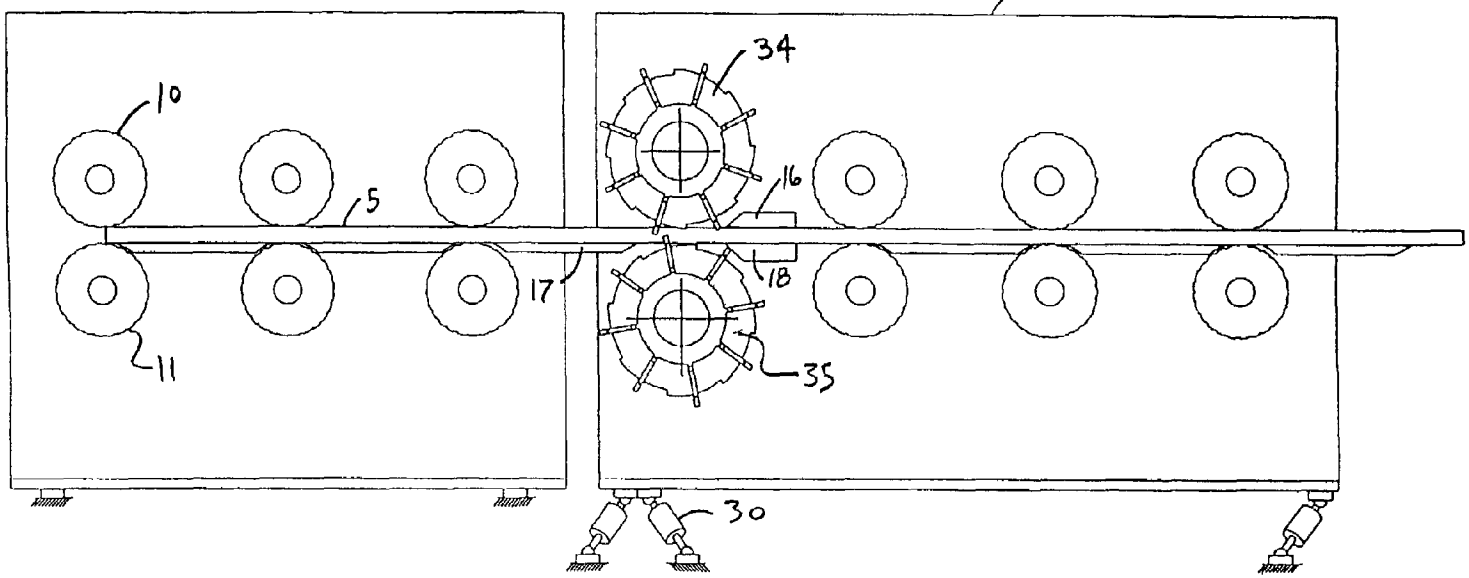
FIG. 18*a* is, in side elevation view, a further embodiment of the optimizing planer according to the present invention having a single plane six axis shaping module with a moveable outfeed section.

FIGS. 18*a-b* show an embodiment similar to FIGS. 17*a-b* but in which the modules 31 and 41 have been combined into a single plane workpiece shaping module with attached outfeed components (multiple axis).

Figure 20:
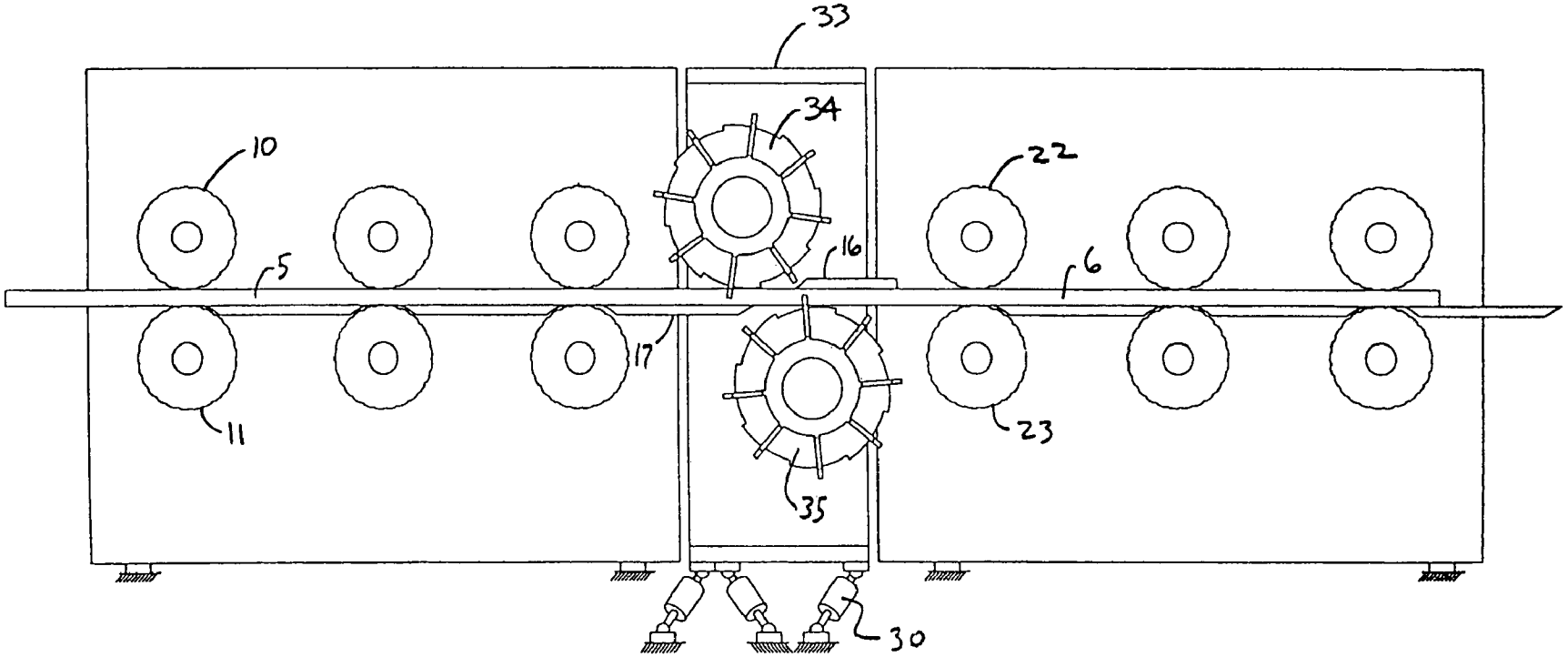
FIG. 20 is, in side elevation view, a further embodiment of the optimizing planer according to the present invention having an offset planer head six axis shaping module.
Figure 21:
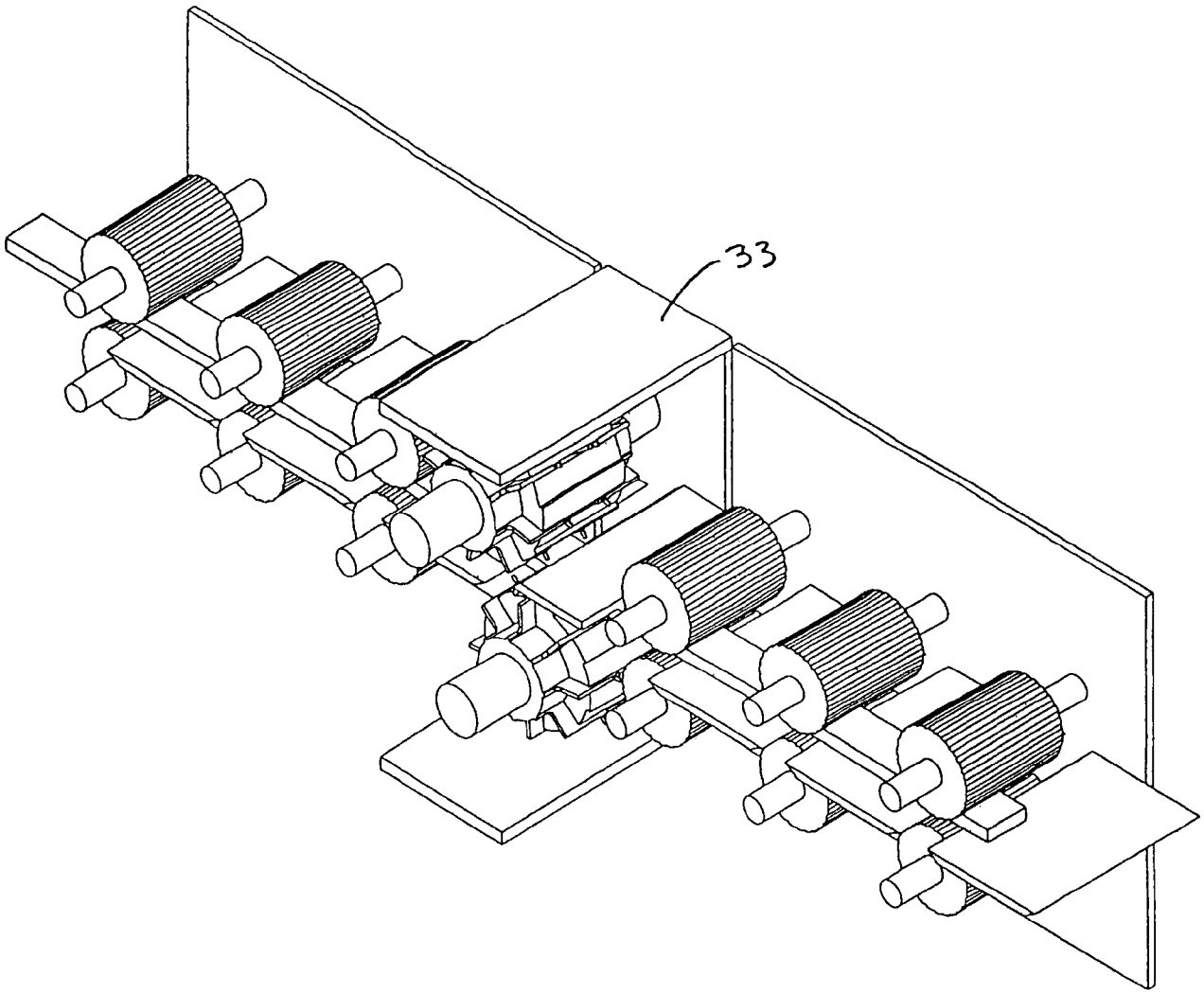
FIG. 21 is, in perspective view, the optimizing planer of FIG. 20.

FIGS. 20 and 21 show an alternative embodiment of an optimizing planer similar to that as shown in FIGS. 17*a-b*, 18*a-b* and 19 where the infeed and outfeed guides and feed rolls are again held stationary during operation but the top and bottom cutting elements are offset. This design provides better workpiece support during planing by the top and bottom heads. This design would not need a mechanism to time the two heads with each other.

Figure 22B:
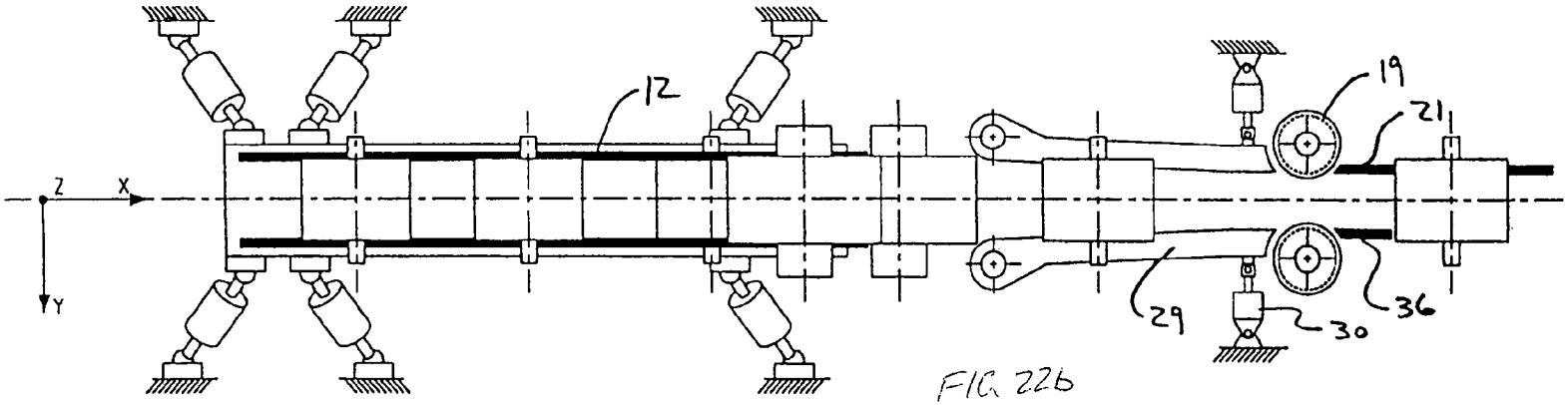
FIG. 22*b* is, in plan view, the optimizing planer of FIG. 22*a*.
Figure 22A:
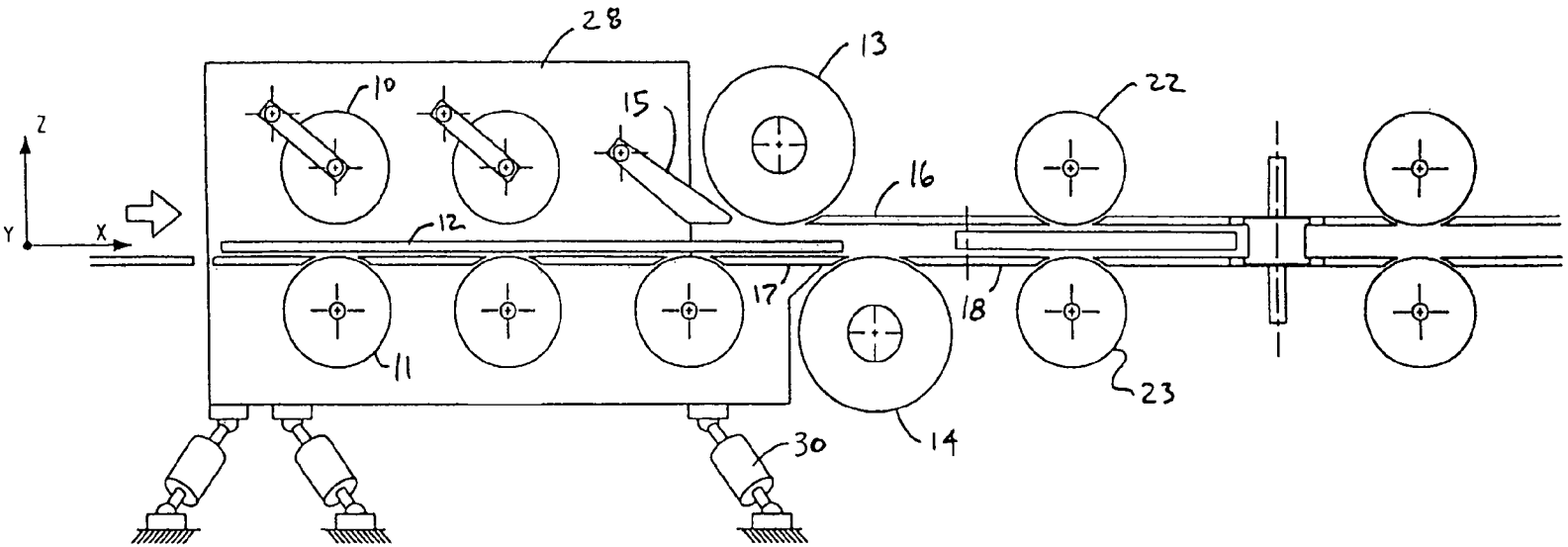
FIG. 22*a* is, in side elevation view, a further embodiment of the optimizing planer according to the present invention having a six axis infeed positioning module and an intermediate side steering module.

FIGS. 22*a-b* show an alternative embodiment of an optimizing planer that is similar to the preferred embodiment as shown in FIGS. 15*a-b* where the cutting elements are held stationary during operation. This design differs in that the infeed positioning module is controlled by actuators that provide up to six axes of control. This includes control of:

a) forward and backwards (X axis movement), b) side-to-side (Y axis linear movement), c) up-and-down (Z axis linear movement), d) twist (X axis rotation), e) pitch (Y axis rotation), and f) skew (Z axis rotation).

These additional degrees of control may help to provide more optimum workpiece orientation with cutting and outfeed components.

Figures 23A, 23B:
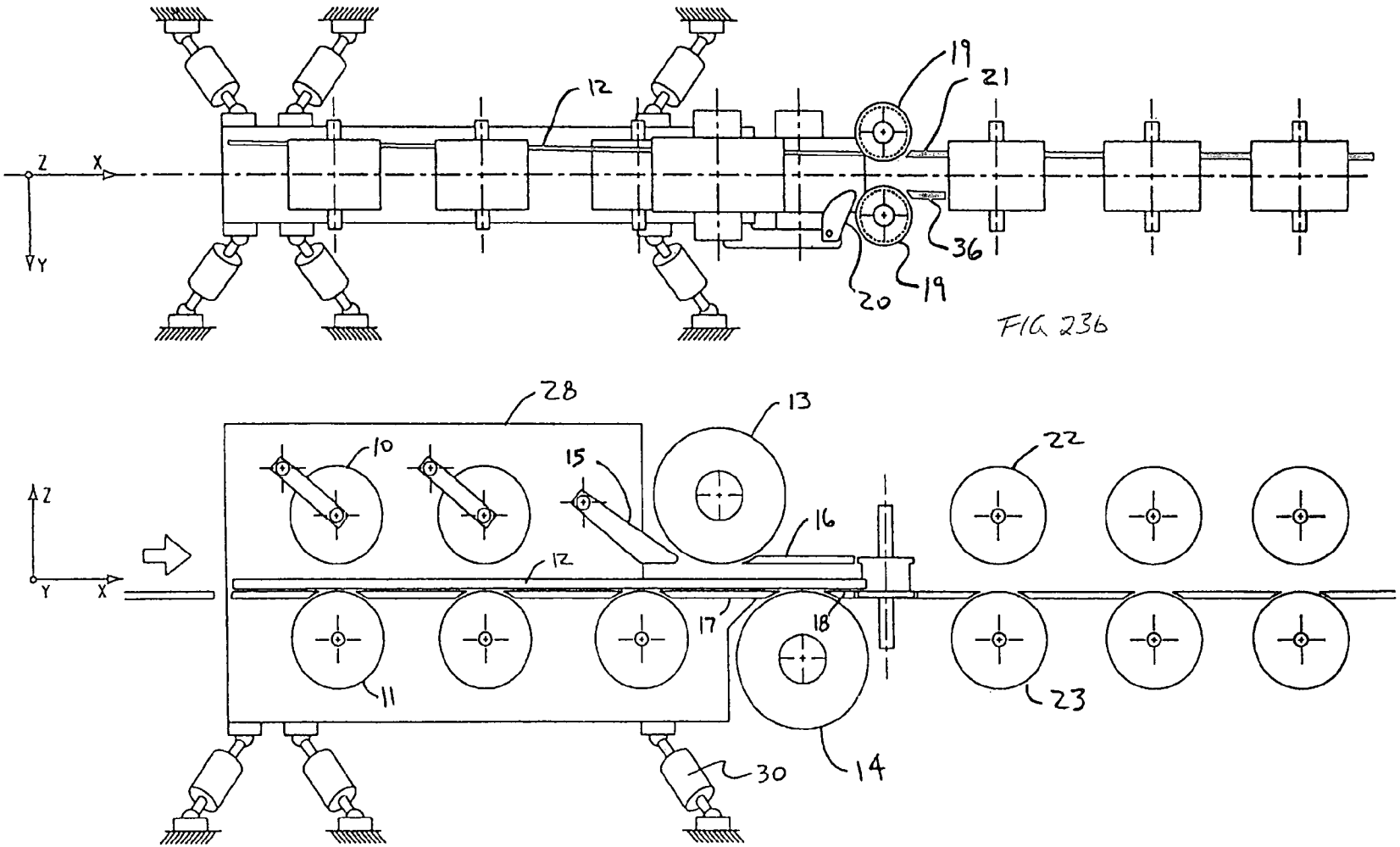
FIG. 23*a* is, in side elevation view, a further embodiment of the optimizing planer according to the present invention having a six axis infeed positioning module with offset top and bottom heads.
FIG. 23*b* is, in plan view, the optimizing planer of FIG. 23*a*.

FIGS. 23*a-b* show an alternative embodiment of an optimizing planer that is similar to the embodiment as shown in FIGS. 22*a-b*. Again up to six axes of control are used with stationary cutting elements. This design differs in that the side cutting heads are located just after the top and bottom heads. The workpiece is positioned in the Y-axis by the infeed positioning module rather than the intermediate positioning module with side head steering anvils. Again an infeed positioning module is used with up to six axes of control.

Figure 24B:
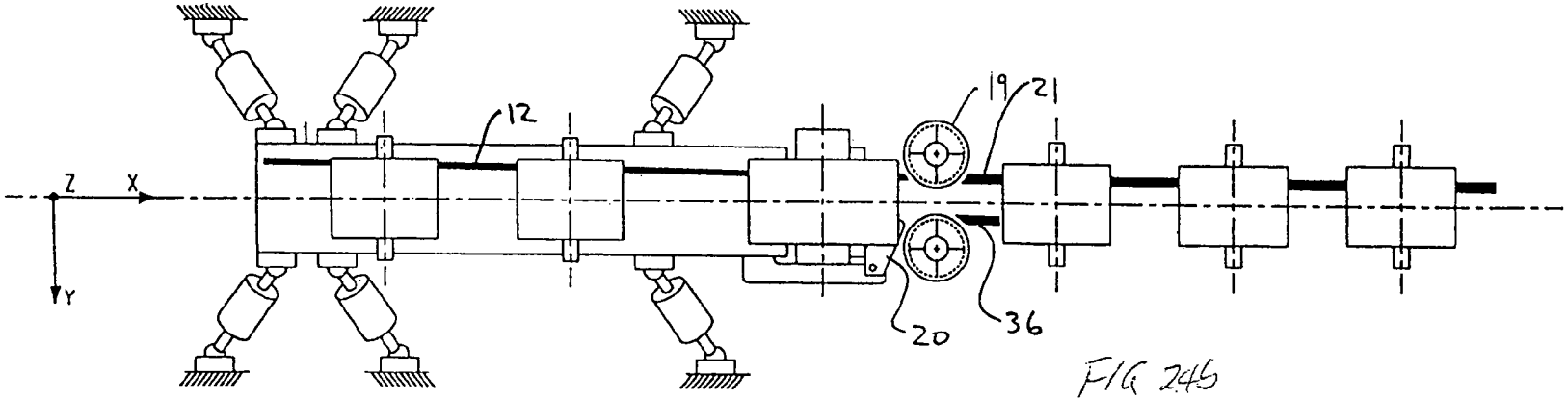
FIG. 24*b* is, in plan view, the optimizing planer of FIG. 24*a*.
Figure 24A:
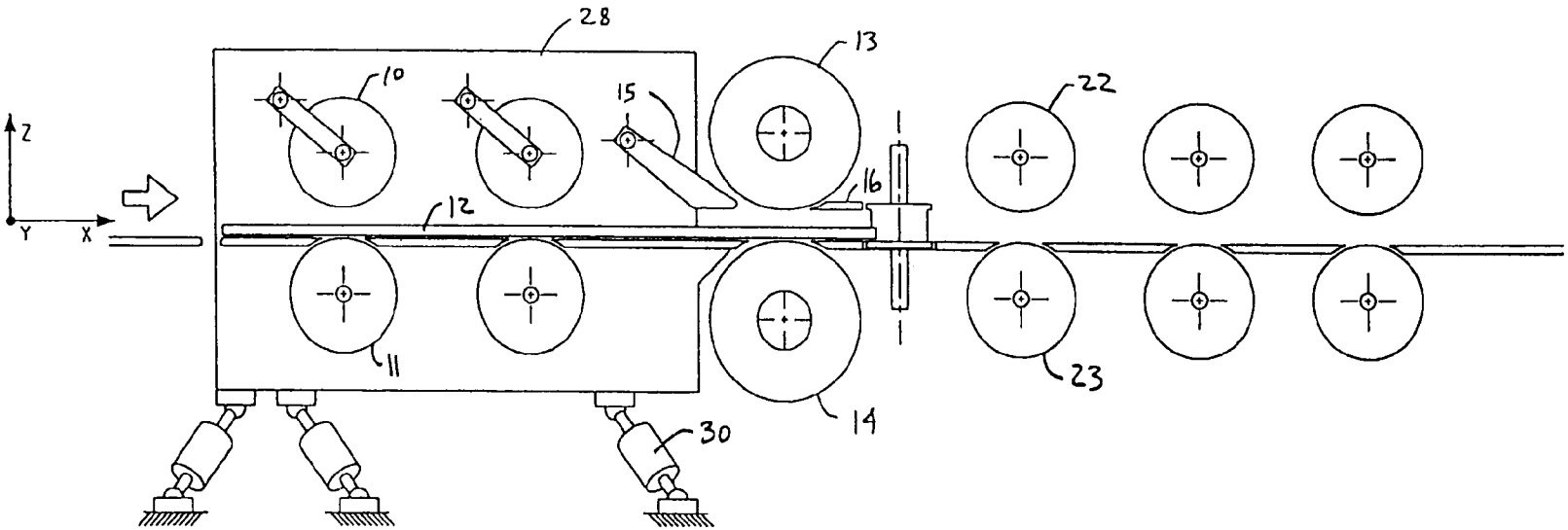
FIG. 24*a* is, in side elevation view, a further embodiment of the optimizing planer according to the present invention having a six axis infeed positioning module with inline top and bottom heads.

FIGS. 24*a-b* show an alternative embodiment of an optimizing planer that is similar to the embodiment as shown in FIGS. 23*a-b*. Again up to six axes of control is used with stationary cutting elements. This design differs in that the top planer head is located directly above the bottom planer head.

An alternative embodiment of an optimizing planer (not shown) is possible similar to the embodiment shown in FIGS. 24*a-b* where an infeed positioning module is used with stationary planer heads except that the workpiece is shaped in approximately a single plane with combination top/side and bottom/side planer heads as shown in FIGS. 17 through 21.

Figure 25A:
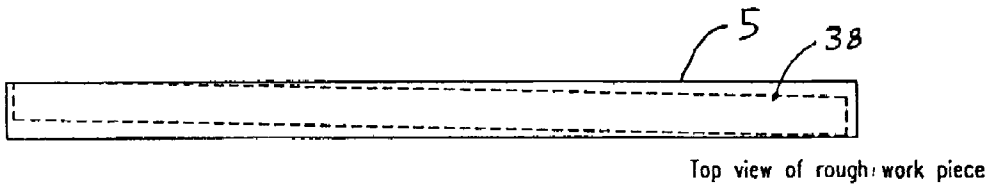
FIG. 25*a* is, in plan view, the rough workpiece of FIG. 25.
Figure 25:
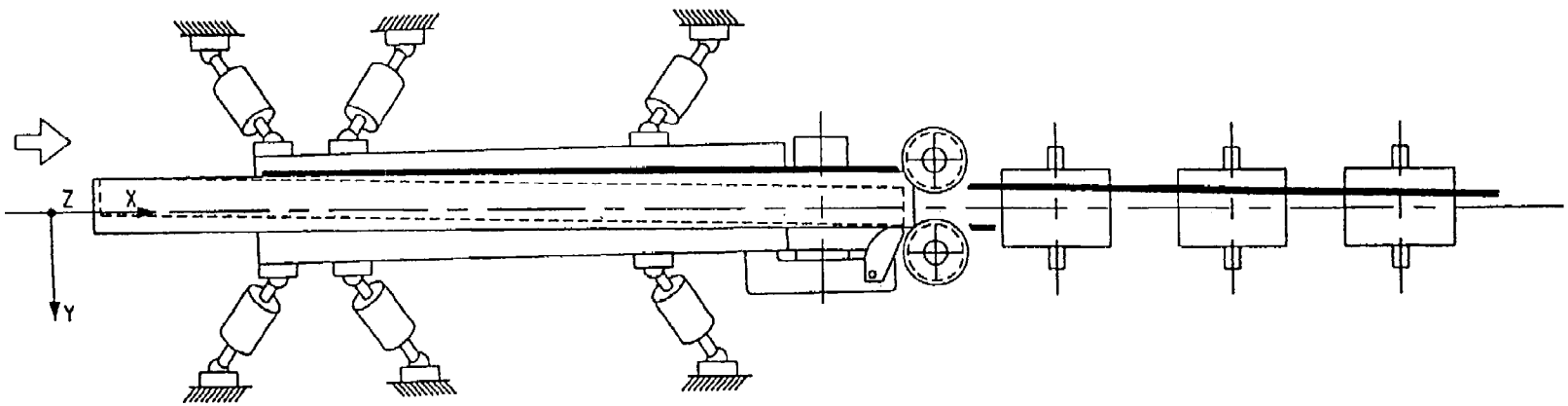
FIG. 25 is, in plan view, an optimizing planer according to one embodiment of the present invention illustrating one infeed embodiment.
Figure 26A:
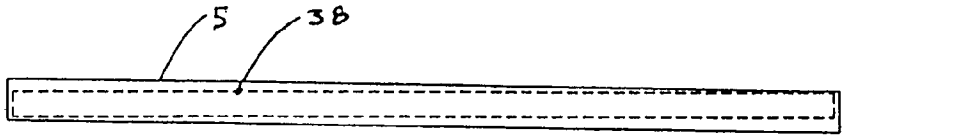
FIG. 26*a* is, in side elevation view, the rough workpiece of FIG. 26.
Figure 26:
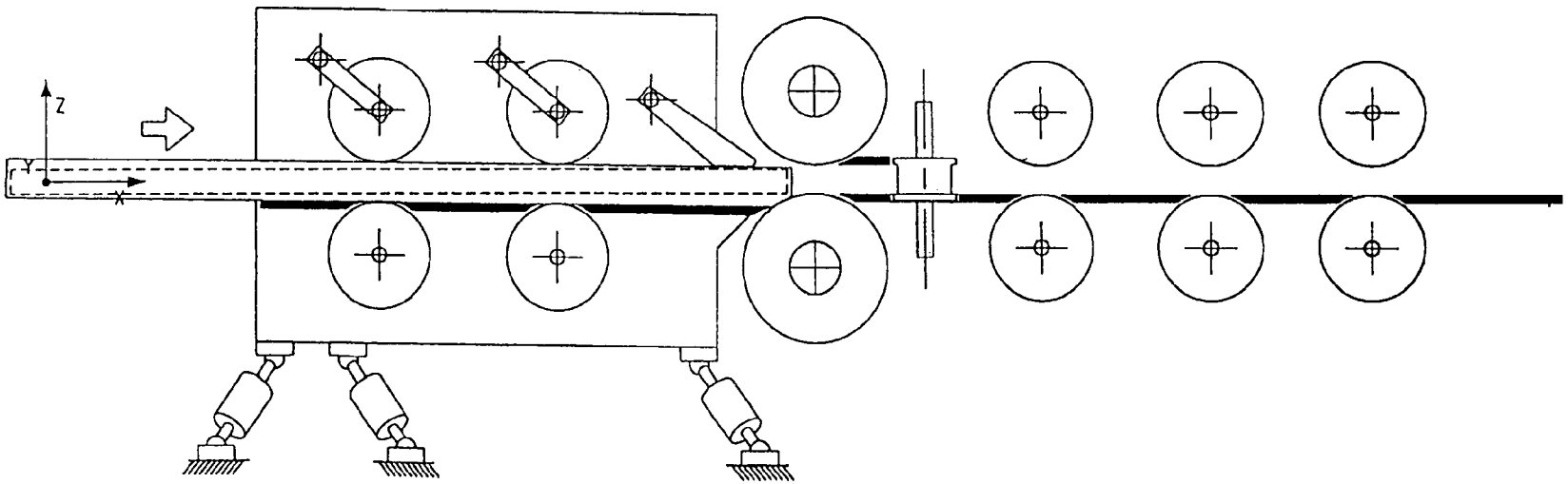
FIG. 26 is, in side elevation view, the optimized planer of FIG. 25.
Figure 27:
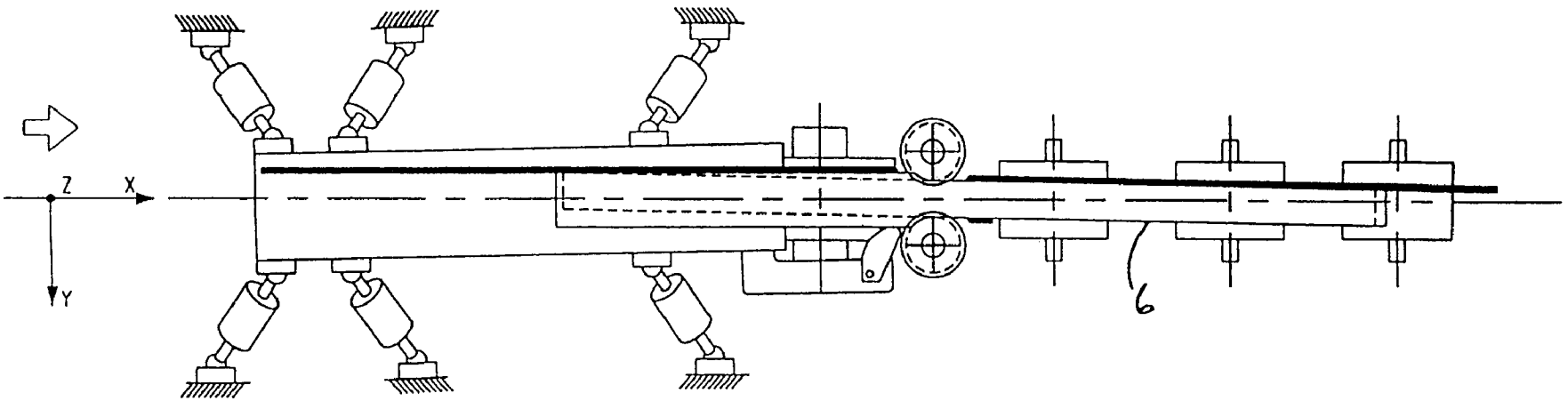
FIG. 27 is, in plan view, the optimizing planer of FIG. 25 with the rough workpiece advancing through the planer.

FIGS. 25 through 28 show an example of a single workpiece moving through an optimizing planer with a six axis infeed positioning module and stationary cutting elements. FIGS. 25-25*a* and 27 show the top view of the optimized planing operation. The rough workpiece is shown with the intended finished piece outlined with a dashed line. In this example, the infeed positioning module rotates (about the Z axis) and translates (Y axis linear) to line up the edge of the intended finished piece with the tail guide located in the outfeed section. As the workpiece moves through the planer the infeed positioning module continues to rotate and translate to maintain the lineup of the edge of the intended finished workpiece with the tail guide.

Figure 28:
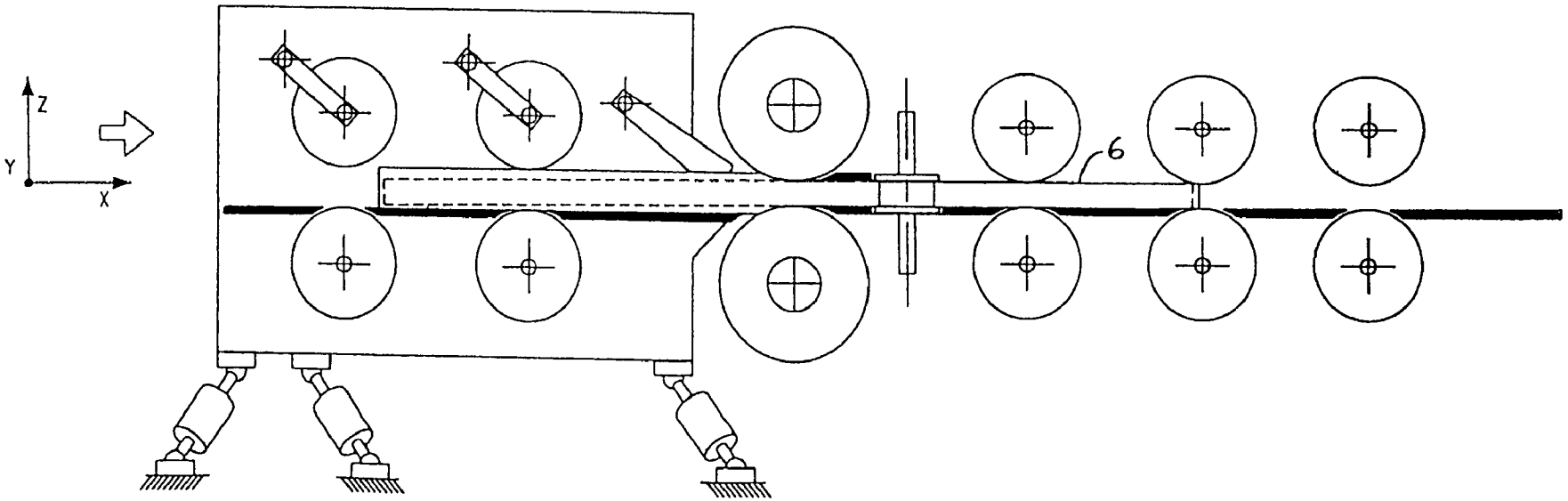
FIG. 28 is, in side elevation view, the optimizing planer of FIG. 27.

FIGS. 26-26*a* and 28 show the side view of the same workpiece as it moves through the same optimizing planer. The infeed positioning module rotates (about the Y axis) and translates (Z axis linear) to line up the bottom edge of the intended finished piece with the tail plate and outfeed rolls (FIGS. 26-26*a*). Again, as the workpiece moves through the planer the infeed positioning module continues to rotate and translate to maintain the lineup of the bottom edge of the intended finished workpiece with the outfeed components (FIG. 28).

Figure 29B:
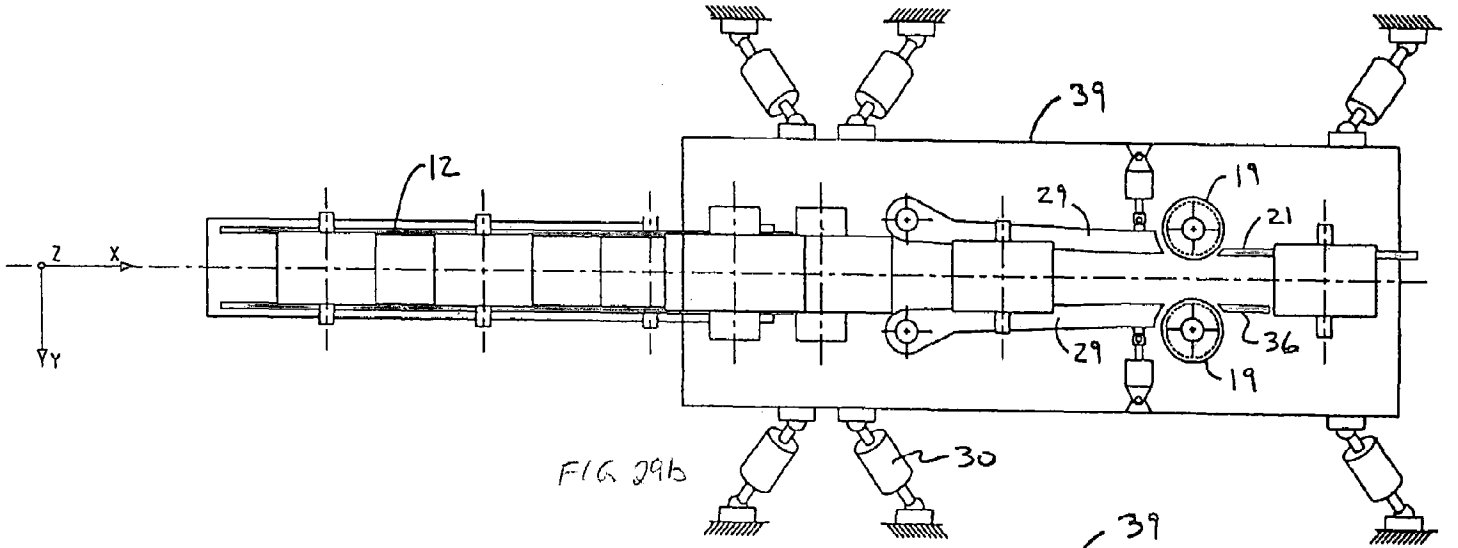
FIG. 29*b* is, in plan view, the optimizing planer of FIG. 29*a*.
Figure 29A:
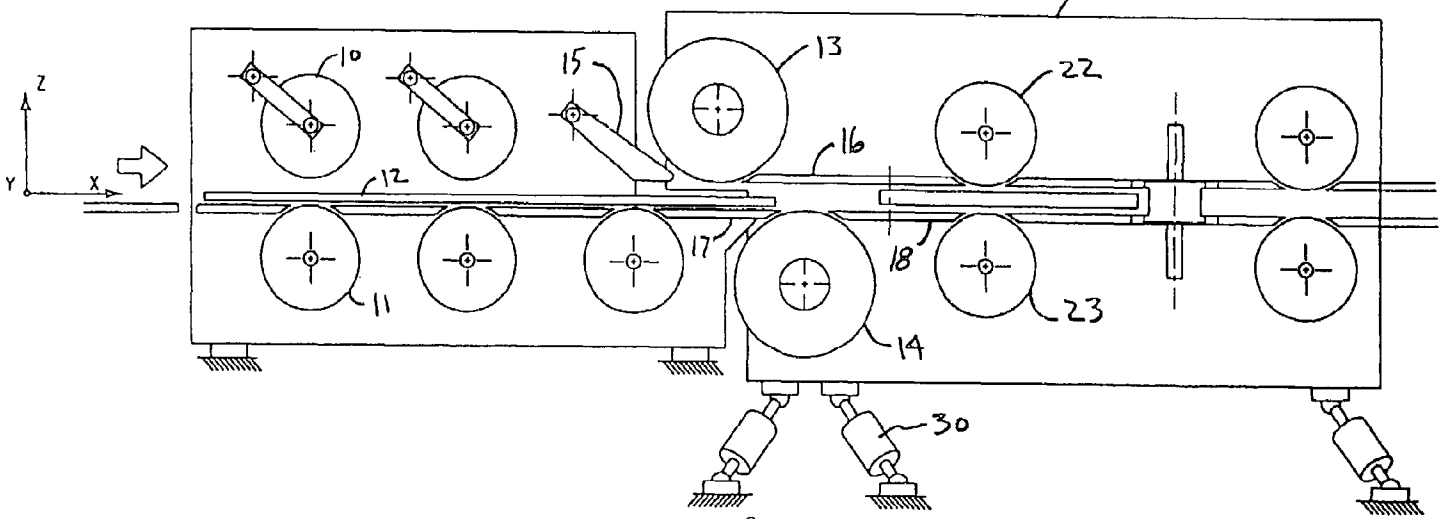
FIG. 29*a* is, in side elevation view, a further embodiment of the optimizing planer according to the present invention having a six axis outfeed positioning module and an intermediate side steering module.

FIGS. 29*a-b* show an alternative embodiment of an optimizing planer where the cutting elements and the outfeed components are moved together in a single module with up to six axes of control. Side steering anvils are used to control the workpiece into the side heads.

Figures 30A, 30B:
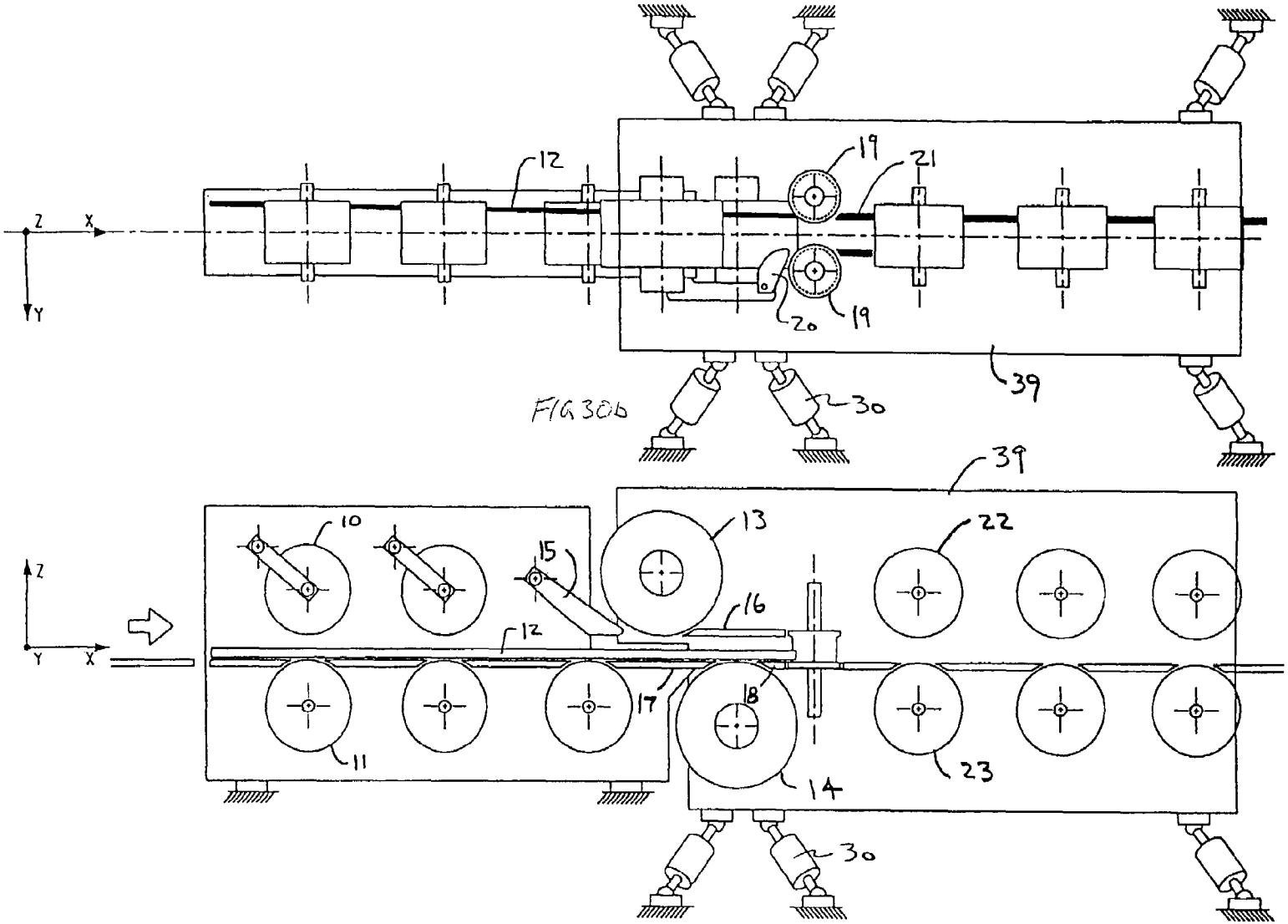
FIG. 30*a* is, in side elevation view, a further embodiment of the optimizing planer according to the present invention having a six axis outfeed positioning module and offset main planer heads.
FIG. 30*b* is, in plan view, the optimizing planer of FIG. 30*a*.

FIGS. 30*a-b* show an alternative embodiment of an optimizing planer similar to the embodiment shown in FIGS. 29*a-b* except the location of the side heads is moved to just after the top and bottom heads. Independently actuated steering anvils are not used in this case.

Figures 31A, 31B:
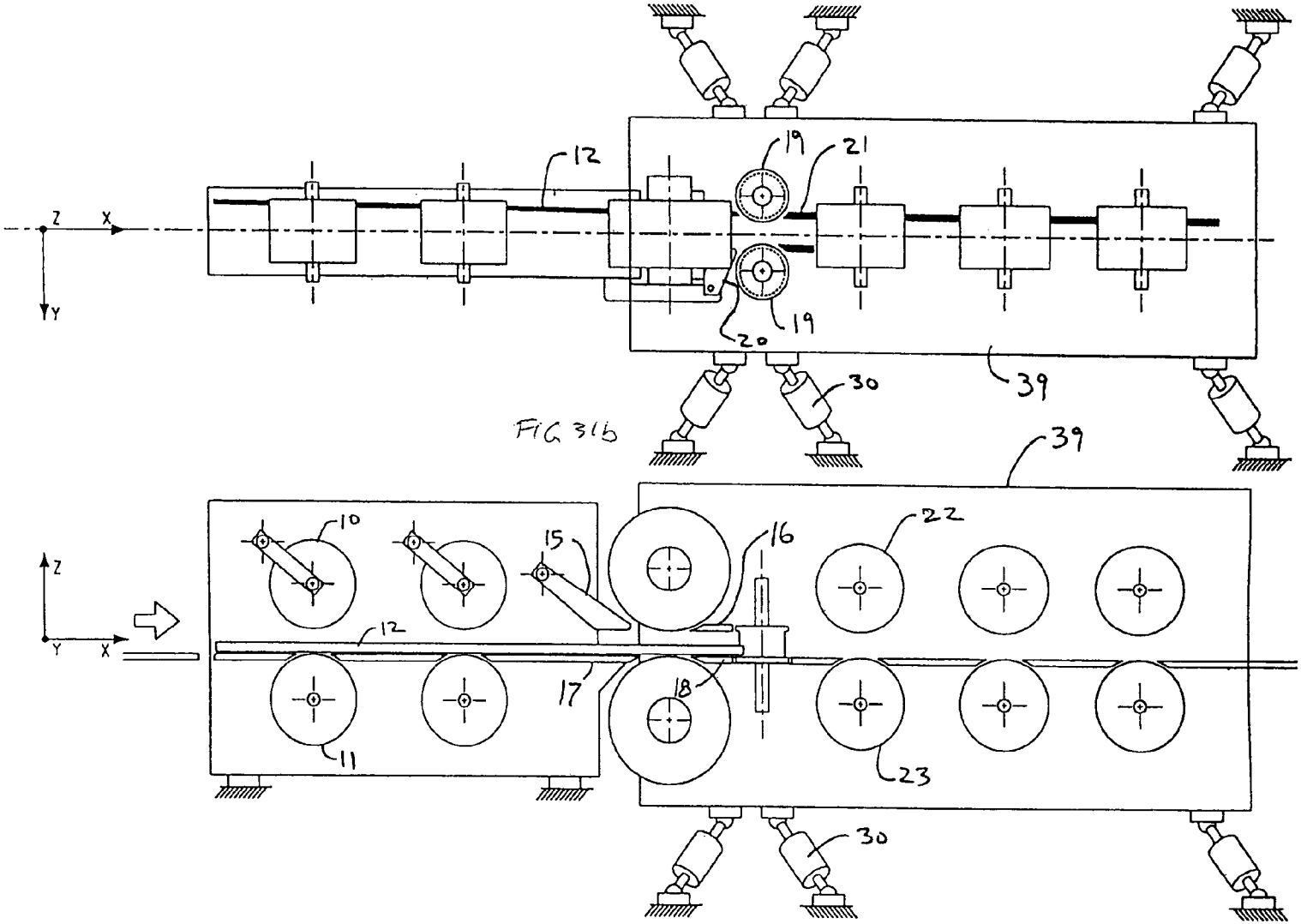
FIG. 31*a* is, in side elevation view, a further embodiment of the optimizing planer according to the present invention having a six axis outfeed positioning module with inline main planer heads.
FIG. 31*b* is, in plan view, the optimizing planer of FIG. 31*a*.

FIGS. 31*a-b* show an alternative embodiment of an optimizing planer similar to the embodiment shown in FIGS. 30*a-b* except the top and bottom heads are positioned inline.

Figures 32A, 32B:
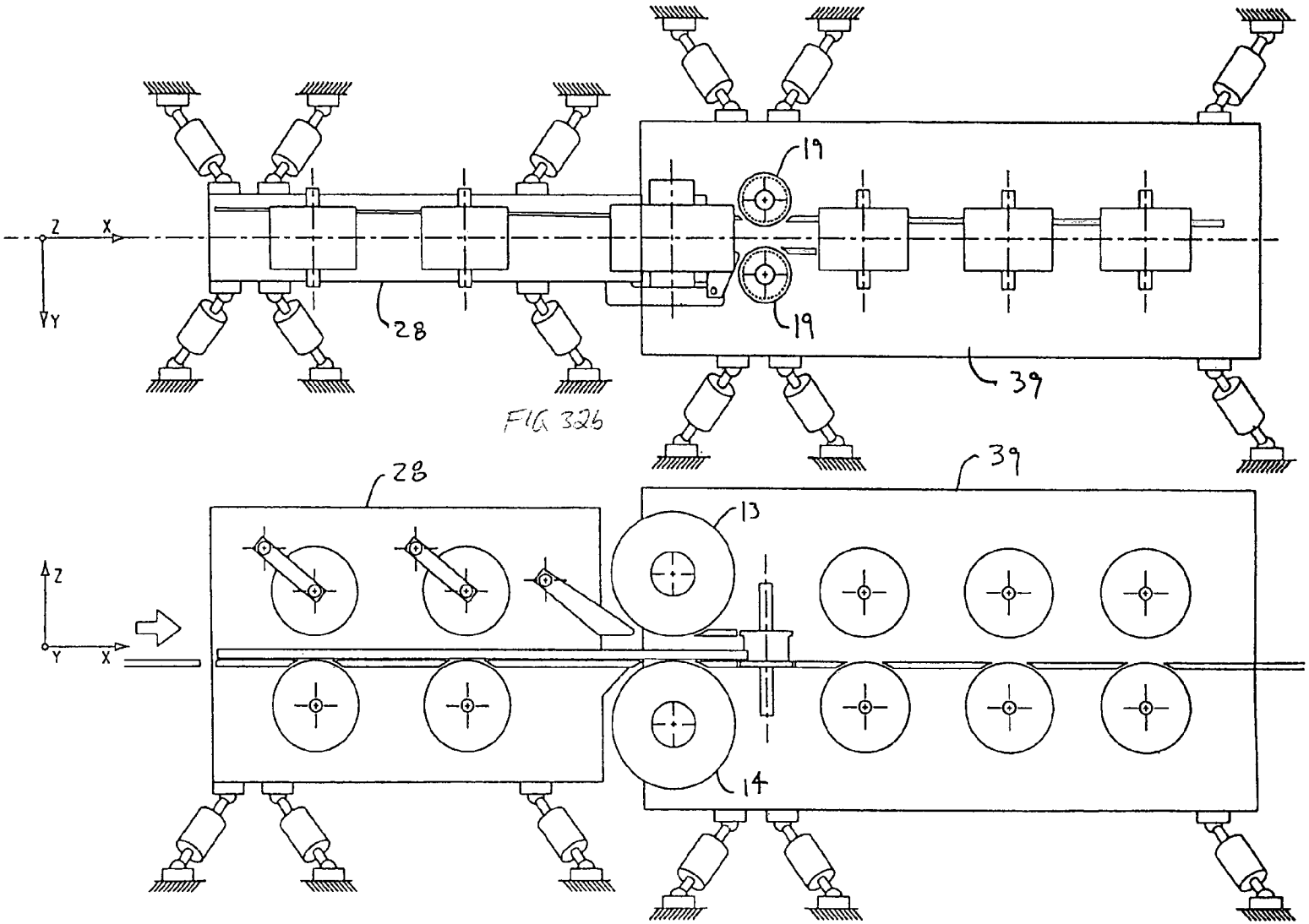
FIG. 32*a* is, in side elevation view, a further embodiment of the optimizing planer according to the present invention having six axis infeed and outfeed positioning modules with the head on the outfeed.
FIG. 32*b* is, in plan view, the optimizing planer of FIG. 32*a*.

FIGS. 32*a-b* show an alternative embodiment of an optimizing planer similar to the embodiment shown in FIGS. 31*a-b* except the infeed module is also moved with up to six degrees of control.

Figures 33A, 33B:
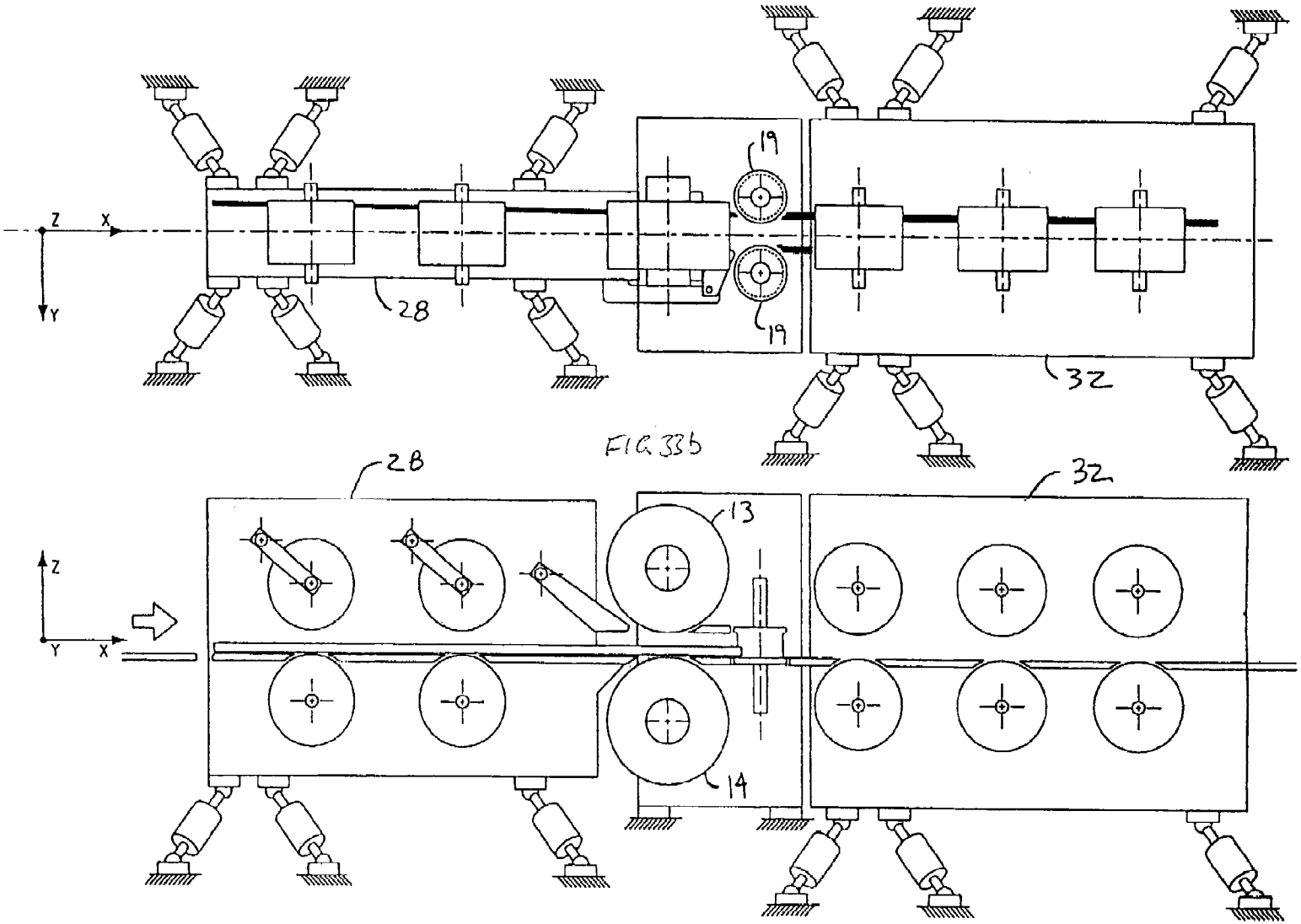
FIG. 33*a* is, in side elevation view, a further embodiment of the optimizing planer according to the present invention having six axis infeed and outfeed positioning modules with stationary heads therebetween.
FIG. 33*b* is, in plan view, the optimizing planer of FIG. 33*a*.

FIGS. 33*a-b* show an alternative embodiment of an optimizing planer similar to the embodiment shown in FIGS. 32*a-b* except the cutting elements are held stationary.

An additional embodiment is also possible (not shown) similar to the embodiment shown in FIGS. 33*a-b* except that only a portion of the cutting elements are stationary.

Figure 35:
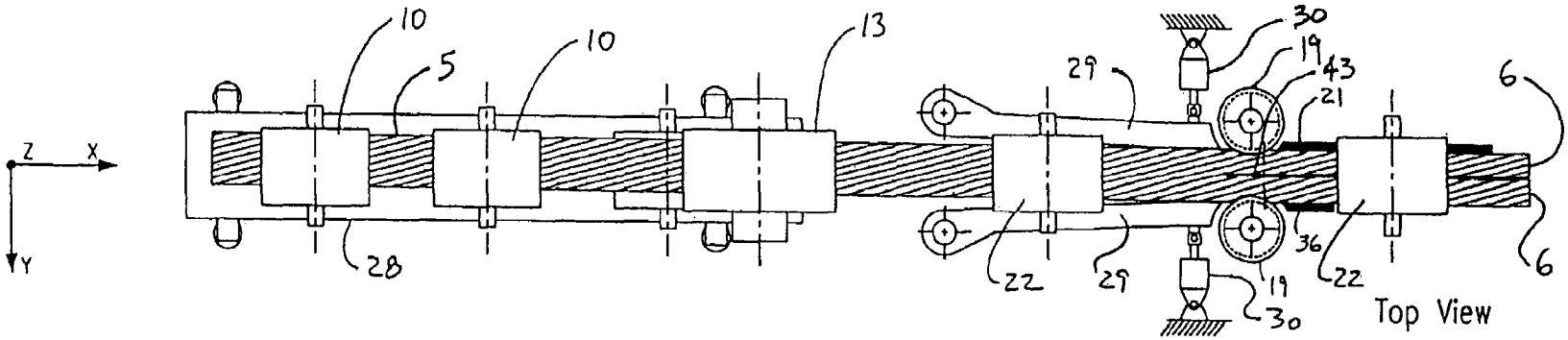
FIG. 35 is, in plan view, a further embodiment of the optimizing planer according to the present invention having interior profiling so as to split a workpiece into two pieces.
Figure 34:
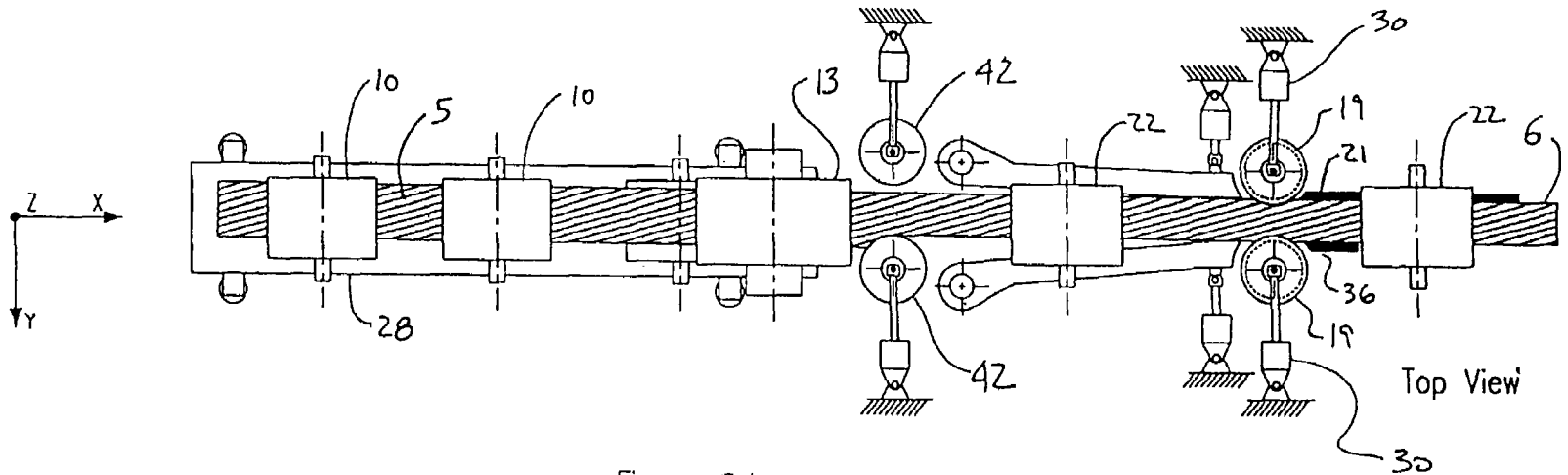
FIG. 34 is, in plan view, a further embodiment of the optimizing planer according to the present invention having upstream side pre-cut so as to reduce a workpiece to a smaller nominal size.

FIGS. 34 and 35 show alternative embodiments of an optimizing planer similar to the preferred embodiment shown in FIGS. 15*a-b* except these designs allow gross size changes to be made to selective workpieces being processed. These gross size changes are typically made for the purpose of extracting the highest value finished piece or pieces from each incoming rough workpiece.

FIG. 34 shows an alternative embodiment where side chipper heads are selectively used after the top and bottom planer heads to make significant size reductions to specific workpieces before they are fed into the side planer head portion of the machine. For example, an individual rough 2×8 piece of lumber that was predicted to produce a low grade finished product could be converted into a high grade 2×6 if this would result in the highest achievable value for that particular piece. The narrower piece would then get directed out of the main flow of finished workpieces.

FIG. 35 shows an alternative embodiment where an internal cutter, such as one or more circular saw blades, is selectively positioned at the interior of a given workpiece for the purpose of splitting the piece into two pieces. The intent may be to produce two usable finished workpieces or one usable and one discardable workpiece from a selected rough workpiece. For example, producing two 2×4s may be the most optimized way to process a given 2×8. Two cutters or saw blades may be used where one is positioned from above and the other is positioned from below the workpiece in order to permit certain profile geometries.

The control system may comprise a conventional type of controller designed for saw mill operations. Examples of such controllers include those made by Allen Bradley of Rockwell Automation as Programmable Logic Controllers (PLC) and IBM compatible computers running customized software, written by MPM Engineering specifically for these applications.

Modification and variation can be made to the disclosed embodiments without departing from the subject of the invention.

Figure 36B:
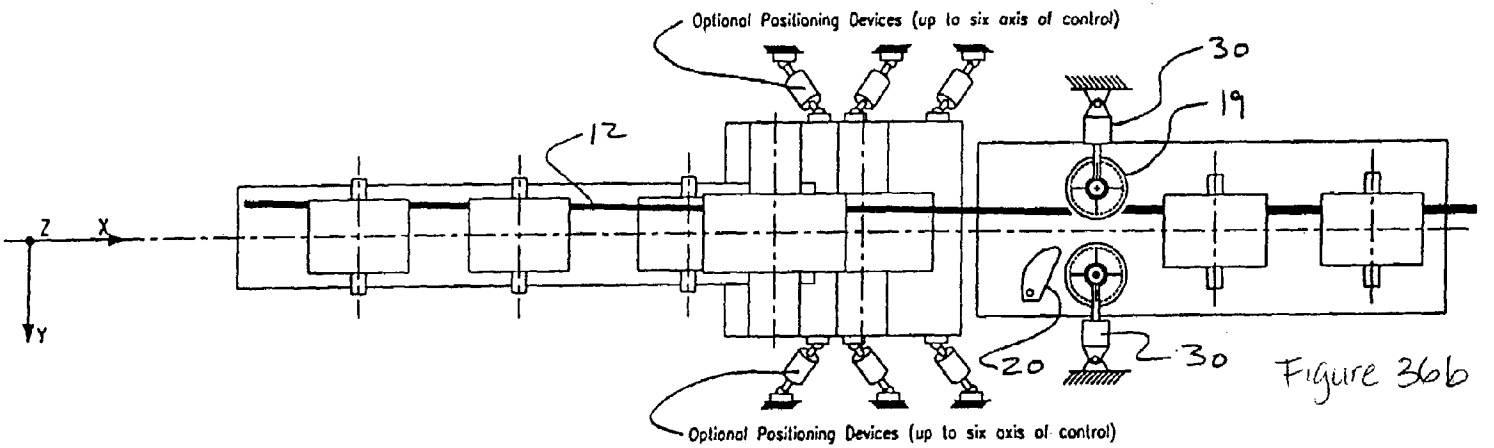
FIG. 36*b* is, in plan view, the optimizing planer of FIG. 36*a*.
Figure 36A:
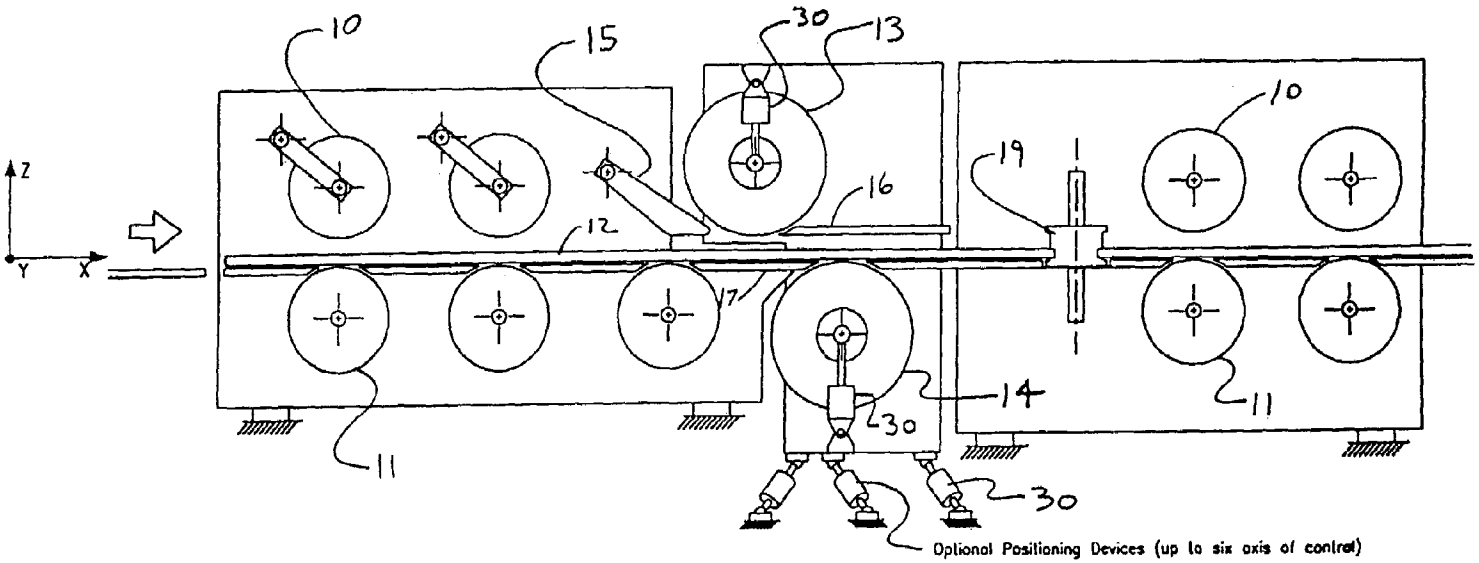
FIG. 36*a* is, in side elevation view, a further embodiment of the optimizing planer according to the present invention having movable cutting elements and offset main planer heads.

FIGS. 36*a-b* show an alternative embodiment where the planer infeed and outfeed rollers are stationary and only the cutting elements and the guiding elements behind the cutting elements are movable. Controlling the movements of only the cutting elements and the guiding elements behind the cutting elements lends itself to converting an existing non-optimized planer into an optimized planer. In order to convert a non-optimized planer into an optimized planer it may be necessary to modify the cutting element and guiding element adjustment and/or positioning system. It may be necessary to remove the existing top, bottom and side cutting elements, guiding elements, positioning or adjusting system and slide ways and replace them with high speed linear positioners and precision guided low friction slide ways. Some examples of high speed linear positioners might include hydraulic linear actuators, ball screw actuators driven by any number of drive methods including, stepper motors, AC vector drives, DC drives, servo motors, hydraulic motors, or AC motors. An example of precision guided low friction slide ways may include Thompson™ linear bearings, Thompson roll way bearings, or possibly THK™ linear bearings and track as is commonly used for slide ways on CNC machine tools. The guiding elements behind the cutting elements may be attached to and move with the cutting element assembly that is associated with, or it may be possible that the guiding elements could have their own high speed linear positioners and precision low friction slide ways. In some instances it may be more cost effective to modify and convert an existing non-optimized planer to an optimized planer than to replace the entire planer with a new optimized planer.

An additional alternative embodiment of the optimized planer that also lends itself as a conversion from a non-optimizing planer is one where the inside guide (straight edge leading up to the side heads) is the movable optimizing device.

An additional alternative embodiment of the optimized planer that also lends itself as a conversion from a non-optimizing planer is one where the bed plate, and possibly the chip breaker above, is the movable optimizing devices.

There may be many benefits to converting a non-optimized planer to an optimized planer. Some examples may include, the cost to convert an existing planer may be significantly less than the cost of a new optimized planer, the downtime and loss of production associated with removing one planer and replacing it with an optimized planer will be greater than the downtime and loss of production associated with converting the non-optimized planer to an optimized planer. The overall cost of installing a new planer will likely be higher than the installation cost of a planer conversion.

The steps taken to convert a non-optimized planer into an optimized planer will depend on the actual configuration of the planer to be converted. Some older planers will require replacement of large amounts of component parts while newer fabricated planers like the Coastal™ or USNR™ planers will require much less modification to convert them to optimized planers. In general, however, all non-optimized planers will at a minimum need modifications to their positioning devices controlling the cutting and/or guiding elements.

As used herein, the following list of reference numerals, and the corresponding elements, denote corresponding elements in each of the views forming part of this specification:

1. Conventional planer
2. Optimizing planer
3. Planer infeed conveyor
4. Outfeed table conveyor
5. Rough workpiece
6. Finished workpiece
7. Grading scanner
8. Linear geometric scanner
9. Traverse geometric scanner
10. Top feed rolls
11. Bottom feed rolls
12. Inside guide
13. Top planer headBottom planer head
14. Top chip breaker
15. Pressure bar
16. Bed plate
17. Tail plate
18. Inside and outside planer heads
19. Side chip breaker
20. Tail guide
21. Top outfeed rolls
22. Bottom outfeed rolls
23. Control system
24. Desired cross-sectional profile (within the workpiece)
25. Wane defect
26. Wedge defect
27. Multiple axis infeed positioning module
28. Intermediate feed module with side head steering anvils
29. Linear positioner
30. Single plane workpiece shaping module (multiple axis)
31. Outfeed module (multiple axis)
32. Offset workpiece shaping module (multiple axis)
33. Combination top/side head
34. Combination bottom/side head
35. Side head guide
36. Single plane workpiece shaping module with attached outfeed components (multiple axis)
37. Desired outline of the finished workpiece (end-to-end)
38. Offset workpiece shaping module with attached outfeed components (multiple axis)
39. Infeed guide and feed roll module
40. Outfeed guide and feed roll module
41. Side chipper heads
42. Internal cutter As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An optimizing planer system comprising:

(a) a control system;

(b) a workpiece feed path;

(c) an optimizing planer operably coupled to the control system, the optimizing planer located along the workpiece feed path and having an entrance, for receipt of a rough workpiece, and an exit, for discharge of an at least partially finished workpiece, the optimizing planer having a cutting element;

(d) a workpiece interrogator situated along the workpiece feed path upstream of the entrance and operably coupled to the control system so to provide the control system with workpiece property information for each workpiece entering the optimizing planer;

(e) the control system constructed to provide the optimizing planer with control information based upon the workpiece property information for each workpiece; and (f) the optimizing planer constructed to move at least one of the workpiece and the cutting element as the workpiece passes through the optimizing planer according to the control information for each workpiece, wherein said control system determines an optimized cross-sectional profile for planing by said optimized planer for each workpiece interrogated by said interrogator based upon said workpiece property information so as to optimize said planing of each said workpiece by said optimizing planer, and wherein said control system adjusts the cross-sectional location of said optimized cross-sectional profile along the length of a workpiece to optimize both workpiece-to-workpiece cross-sectional profiles between adjacent workpieces on said feed path and the cross-sectional profile within a single workpiece.

2. The system of claim 1 wherein said workpiece interrogator includes a plurality of profile and/or defect detectors for collectively detecting the workpiece property information and a compiler for compiling the property information from said plurality of profile and/or defect detectors into a single workpiece property information profile for each workpiece.

3. The system of claim 1 further comprising means within said control system for determining constraints to balance the amount of self-produced defects including twist, bow or snipe produced in the workpiece as a result of said adjusting of the cross-sectional location of said optimized cross-sectional profile.

4. The system of claim 1, further comprising a grading scanner situated along the workpiece feed path downstream of the exit of the optimizing planer, the grading scanner for providing feedback to the control system regarding the cross-sectional profile of the at least partially finished workpiece.

5. An optimizing planer system comprising:

(a) an optimizing planer having an entrance, for receipt of a rough workpiece, and an exit, for discharge of an at least partially finished workpiece, the optimizing planer having a cutting element;

(b) means for interrogating each workpiece entering the optimizing planer and creating workpiece property information therefor;

(c) control system means, operably coupled to the workpiece interrogating means, for providing the optimizing planer with control information based upon the workpiece property information for each workpiece; and (d) the optimizing planer comprising means for moving at least one of the workpiece and the cutting element as the workpiece passes through the optimizing planer according to the control information for each workpiece, wherein said control system means determines an optimized cross-sectional profile for planing by said optimized planer for each workpiece interrogated by said means for interrogation based upon said workpiece property information so as to optimize said planing of each said workpiece by said optimizing planer, and wherein said control system means adjusts the cross-sectional location of said optimized cross-sectional profile along the length of a workpiece to optimize both workpiece-to-workpiece cross-sectional profiles between adjacent workpieces on said feed path and the cross-sectional profile within a single workpiece.

6. The system of claim 5 wherein said means for interrogating includes a plurality of profile and/or defect detectors for collectively detecting the workpiece property information and a compiler for compiling the property information from said plurality of profile and/or defect detectors into a single workpiece property information profile for each workpiece.

7. The system of claim 5 further comprising means within said control system means for determining constraints to balance the amount of self-produced defects including twist, bow or snipe produced in the workpiece as a result of said adjusting of the cross-sectional location of said optimized cross-sectional profile.

8. A method for planer optimization comprising:

(a) feeding a series of workpieces to an optimizing planer;

(b) interrogating each workpiece prior to entering the optimizing planer to formulate workpiece property information for each workpiece;

(c) creating control information for each workpiece from the workpiece property information according to a desired cross-sectional profile along the length of the workpiece;

(d) controlling the cutting operation of the optimizing planer for each workpiece based upon the control information for each workpiece; and (e) adjusting the location of the desired cross-sectional profile within the workpiece to optimize planing within the workpiece and to optimize planing in workpiece-to-workpiece planing between the workpiece and a next adjacent workpiece in said series of workpieces.

9. The system of claim 8 further comprising the step of providing a plurality of profile and/or defect detectors and wherein said interrogating each workpiece further comprises collectively detecting the workpiece property information by said plurality of profile and/or defect detectors and compiling the property information from said plurality of profile and/or defect detectors into a single workpiece property information profile for each workpiece.

10. The system of claim 8 further comprising the step of constraining said adjusting of the location of the desired cross-sectional profile to balance the amount of self-produced defects including twist, bow or snipe produced in the workpiece as a result of said adjusting of the location of the desired cross-sectional profile.

11. An optimizing planer system comprising:

(a) a control system;

(b) a workpiece feed path;

(c) an optimizing planer operably coupled to the control system, the optimizing planer located along the workpiece feed path and having an entrance, for receipt of a rough workpiece, and an exit, for discharge of an at least partially finished workpiece, the optimizing planer having a cutting element;

(d) a workpiece interrogator situated along the workpiece feed path upstream of the entrance and operably coupled to the control system so to provide the control system with workpiece property information for each workpiece entering the optimizing planer;

(e) the control system constructed to provide the optimizing planer with control information based upon the workpiece property information for each workpiece; and (f) the optimizing planer constructed to move at least one of the workpiece, cutting element or guiding element as the workpiece passes through the optimizing planer according to the control information for each workpiece, wherein said control system determines an optimized cross-sectional profile for planing by said optimized planer for each workpiece interrogated by said interrogator based upon said workpiece property information so as to optimize said planing of each said workpiece by said optimizing planer, and wherein said control system adjusts the cross-sectional location of said optimized cross-sectional profile along the length of a workpiece to optimize both workpiece-to-workpiece cross-sectional profiles between adjacent workpieces on said feed path and the cross-sectional profile within a single workpiece.

12. The system of claim 11 wherein said workpiece interrogator includes a plurality of profile and/or defect detectors for collectively detecting the workpiece property information and a compiler for compiling the property information from said plurality of profile and/or defect detectors into a single workpiece property information profile for each workpiece.

13. The system of claim 11 further comprising means within said control system for determining constraints to balance the amount of self-produced defects including twist, bow or snipe produced in the workpiece as a result of said adjusting of the cross-sectional location of said optimized cross-sectional profile.

14. An optimizing planer system comprising:

(a) an optimizing planer having an entrance, for receipt of a rough workpiece, and an exit, for discharge of an at least partially finished workpiece, the optimizing planer having a cutting element;

(b) means for interrogating each workpiece entering the optimizing planer and creating workpiece property information therefor;

(c) control system means, operably coupled to the workpiece interrogating means, for providing the optimizing planer with control information based upon the workpiece property information for each workpiece; and (d) the optimizing planer comprising means for moving at least one of the workpiece, the cutting element or the guiding element as the workpiece passes through the optimizing planer according to the control information for each workpiece;

wherein said control system means determines an optimized cross-sectional profile for planing by said optimized planer for each workpiece interrogated by said means for interrogation based upon said workpiece property information so as to optimize said planing of each said workpiece by said optimizing planer, and wherein said control system means adjusts the cross-sectional location of said optimized cross-sectional profile along the length of a workpiece to optimize both workpiece-to-workpiece cross-sectional profiles between adjacent workpieces on said feed path and the cross-sectional profile within a single workpiece.

15. The system of claim 14 wherein said means for interrogating includes a plurality of profile and/or defect detectors for collectively detecting the workpiece property information and a compiler for compiling the property information from said plurality of profile and/or defect detectors into a single workpiece property information profile for each workpiece.

16. The system of claim 14 further comprising means within said control system means for determining constraints to balance the amount of self-produced defects including twist, bow or snipe produced in the workpiece as a result of said adjusting of the cross-sectional location of said optimized cross-sectional profile.

17. An optimizing planer system comprising:

(a) a control system;

(b) a workpiece feed path;

(c) an optimizing planer operably coupled to the control system, the optimizing planer located along the workpiece feed path and having an entrance, for receipt of a rough workpiece, and an exit, for discharge of an at least partially finished workpiece, the optimizing planer having a cutting element;

(d) a workpiece interrogator situated along the workpiece feed path upstream of the entrance and operably coupled to the control system so to provide the control system with workpiece property information for each workpiece entering the optimizing planer;

(e) the control system constructed to provide the optimizing planer with control information based upon the workpiece property information for each workpiece; and (f) the optimizing planer constructed to move at least one of the workpiece and the cutting element as the workpiece passes through the optimizing planer according to the control information for each workpiece, and wherein said movement includes relative movement between the workpiece and the cutting element including up-and-down relative movement, pitch relative movement, and twist relative movement.

18. The system of claim 17 wherein said relative movement further comprises side-to-side relative movement, and skew relative movement.

19. The system of claim 17 wherein said optimizing planer includes a plurality of linear positioners mounted for actuating said relative movement between the workpiece and the cutting element.

20. The system of claim 17 wherein said control system determines an optimized cross-sectional profile for planing by said optimized planer for each workpiece interrogated by said interrogator based upon said workpiece property information so as to optimize said planing of each said workpiece by said optimizing planer, and wherein said control system adjusts the cross-sectional location of said optimized cross-sectional profile along the length of a workpiece to optimize both workpiece-to-workpiece cross-sectional profiles between adjacent workpieces on said feed path and the cross-sectional profile within a single workpiece.

21. The system of claim 17 wherein said workpiece interrogator includes a plurality of profile and/or defect detectors for collectively detecting the workpiece property information and a compiler for compiling the property information from said plurality of profile and/or defect detectors into a single workpiece property information profile for each workpiece.

22. The system of claim 17 further comprising means within said control system for determining constraints to balance the amount of self-produced defects including twist, bow or snipe produced in the workpiece as a result of said adjusting of the cross-sectional location of said optimized cross-sectional profile.

* * * * *

UNITED STATES PATENT AND TRADEMARK OFFICE

CERTIFICATE OF CORRECTION

PATENT NO. : 7,490,641 B2
APPLICATION NO. : 10/799600
DATED : February 17, 2009
INVENTOR(S) : Ronald W. McGehee et al.

It is certified that error appears in the above-identified patent and that said Letters Patent is hereby corrected as shown below:

Column 14

Line 6, "...The system of claim 8..." should read --...The method of claim 8...--.

Line 14, "...The system of claim 8..." should read --...The method of claim 8...--.

Signed and Sealed this

Fifteenth Day of June, 2010

David J. Kappos

David J. Kappos
*Director of the United States Patent and Trademark Office*